US005246776A

United States Patent [19]

Meraldi et al.

[11] Patent Number: 5,246,776

[45] Date of Patent: Sep. 21, 1993

[54] ARAMID MONOFILAMENT AND METHOD OF OBTAINING SAME

[75] Inventors: Jean-Paul Meraldi, Zurich; Joel Ribiere, Wallisellen, both of Switzerland

[73] Assignee: Michelin Recherche et Technique, Fribourg, Switzerland

[21] Appl. No.: 651,402

[22] PCT Filed: Jun. 27, 1990

[86] PCT No.: PCT/CH90/00155

§ 371 Date: Feb. 26, 1991

§ 102(e) Date: Feb. 26, 1991

[87] PCT Pub. No.: WO91/00381

PCT Pub. Date: Jan. 10, 1991

[30] Foreign Application Priority Data

Jun. 28, 1989 [FR] France ..... 89 08755
Apr. 11, 1990 [FR] France ..... 90 04790

[51] Int. Cl.[5] ..... D02G 3/00

[52] U.S. Cl. ..... 428/364; 428/371; 428/373; 428/359; 264/184

[58] Field of Search ..... 264/184; 428/364, 373, 428/371, 359

[56] References Cited

U.S. PATENT DOCUMENTS

| | | | |
|---|---|---|---|
| 4,368,615 | 1/1983 | Lammers | 264/184 |
| 4,374,978 | 2/1983 | Fujiwara et al. | 264/184 |
| 4,419,317 | 12/1983 | Fujiwara et al. | 264/184 |
| 4,440,710 | 4/1984 | Fujiwara et al. | 264/184 |
| 4,466,935 | 8/1984 | Bair et al. | 264/184 |
| 4,497,868 | 2/1985 | Reinhr et al. | 428/364 |
| 4,511,623 | 4/1985 | Yoon et al. | 428/364 |
| 4,728,473 | 3/1988 | Satoh et al. | 264/184 |
| 4,859,393 | 8/1989 | Yang et al. | 264/184 |
| 4,985,193 | 1/1991 | Allen | 264/184 |

*Primary Examiner*—Patrick J. Ryan
*Assistant Examiner*—N. O. Edwards
*Attorney, Agent, or Firm*—Brumbaugh, Graves, Donohue & Raymond

[57] ABSTRACT

An aramid monofilament (20), characterized by the fact that it has the following relationships: $1.7 \leqq Ti \leqq 260$; $40 \leqq D \leqq 480$; $T \geqq 170 - D/3$; $Mi \geqq 2000$, Ti being the linear density in tex, D being the diameter in μm, T being the tenacity in cN/tex, and Mi being the initial modulus in cN/tex for this monofilament.

A method of obtaining said monofilament (20) in which a solution (2) of aromatic polyamide(s) is extruded in a spinneret (9), the jet is drawn into a non-coagulating layer of fluid (13), and the drawn liquid vein is introduced into a coagulating medium (19).

Assemblies of such monofilaments. Articles reinforced by these monofilaments or these assemblies, such articles being for instance tires.

34 Claims, 9 Drawing Sheets

1000
800
600
400
200
0
I(u.r)
(A)
(B)
C3-1
13.0
18.0
23.0
28.0
33.0
2θ(DEGREES)

1000
800
600
400
200
0
I(u.r)
(B)
(A)
(X)
C3-2
(Y)
I(X)
I(A)
C3-3
13.0
18.0
23.0
28.0
33.0
2θ(DEGREES)

ARAMID MONOFILAMENT AND METHOD OF OBTAINING SAME

The present invention relates to so-called "aramid" fibers, that is to say fibers of linear macromolecules made from aromatic groups which are joined to each other by amide linkages at least 85% of which are directly joined to two aromatic rings, and, more precisely, aramid fibers produced from optically anisotropic spinning compositions.

It is known to produce such aramid fibers in the form of multifilaments, each of the unit filaments having a linear density of about 1.8 dtex, namely a diameter of about 13 μm. Such fibers are described, for instance, in the following patents or patent applications: EP-A-21 484, EP-A-51 265, EP-A-118,088, EP-A-138,011, Ep-A-168,879, EP-A-218,269, EP-A-247,889, EP-A-248,458, Ep-A-315,253, Ep-A-331,156, EP-A-3,671,542, U.S. Pat. No. 3,767,756, U.S. Pat. No. 3,869,429, U.S. Pat. No. 3,869,430, U.S. Pat. No. 4,340,559, U.S. Pat. No. 4,374,977, U.S. Pat. No. 4,374,978, U.S. Pat. No. 4,419,317, U.S. Pat. No. 4,466,935, U.S. Pat. No. 4,560,743, US. Pat. No. 4,622,265, U.S. Pat. No. 4,698,414, U.S. Pat. No. 4,702,876, U.S. Pat. No. 4,721,755, U.S. Pat. No. 4,726,922, U.S. Pat. No. 4,783,367, U.S. Pat. No. 4,835,223, U.S. Pat. No. 4,869,860.

The methods described in these documents consist essentially in dissolving in a suitable solvent, generally concentrated sulfuric acid, an aromatic polyamide (polymer, copolymer or mixture of polymers) of a molecular structure compatible with the obtaining of a liquid-crystal solution at the spinning temperature of a concentration of generally between 12 and 20% by weight polyamide, extruding the solution through a spinneret, drawing the liquid veins emerging from said spinneret through a layer of air and coagulating them in optimal manner, generally in an aqueous solution of sulfuric acid, in order to assure the high mechanical properties known for these aramid fibers.

The difficulties in effecting such a coagulation increase very rapidly when the diameter of the elementary liquid filament penetrating into the coagulation bath increases.

Thus in U.S. Pat. No. 4,698,414, the maximum filament linear density claimed is about 6.7 dtex, which corresponds to a maximum filament diameter of about 24 μm. It is furthermore stated that the operations of spinning elementary filaments of a diameter of between about 17 and 24 μm are already disturbed by difficulties in coagulation.

This maximum limit of 17 μm, or about 2.7 dtex in terms of linear density, is also claimed or indicated as preferred value in numerous patents or patent applications, such as, for example EP-A-51,265, Ep-A-118,088, Ep-A-138,011, US-A-4,340,559, U.S. Pat. No. 4,374,977, U.S. Pat. No. 4,374,978, U.S. Pat. No. 4,419,317, U.S. Pat. No. 4,560,743.

Furthermore, even before the Coagulation operation, the difficulties in sufficiently orienting molecules of polymers in liquid veins of a high diameter have up to now been considered difficultly compatible with the obtaining of elementary filaments having both a high diameter and high mechanical properties (see, for instance, EP-A-138,011, US-A-374,978, U.S. Pat. No. 4,419,317, U.S. Pat. No. 4,560,743).

The Japanese patent application ("Kokai") published under No. 61-55,210 very briefly describes the production of a monofilament from paraphenylene diamine, terephthaloyl chloride and 4,4'-diaminodiphenylether. This monofilament has a linear density a 100 denier and a tenacity of 16.8 g/denier, no indication being given as to the initial modulus of this monofilament. The properties indicated are obtained only after a hot super-drawing step (draw ratio of 1.8), both the prior spinning operation and the above drawing operation being carried out, in particular, at very low speed. This monofilament is, in fact, obtained from a semi-rigid aromatic copolyamide, the spinning solutions used for the production of this type of fiber being known furthermore to be of low polymer concentration and optically isotropic in the molten state amd at rest. Such aromatic polyamides contain a large fraction of bonds which are responsible for a weak molecular extension, and the products which result therefrom, as a result of these ultra-drawing techniques after spinning, are described for instance in JP-A-62-00534, JP-A-63-92716, JP-A-63-165515.

Taking into account the above-mentioned known principles and the preceding remarks, it was up to now believed by the person skilled in the art that it was not possible to produce directly by spinning aramid monofilaments of a diameter substantially greater than 17 μm while maintaining their mechanical properties, in particular their tenacity and their initial modulus at a high or very high level.

The production of monofilaments of organic polymers of large cross section having high mechanical properties combined with high thermal and chemical resistance was nevertheless very desirable in order, in this way, to obtain products which would be comparable to steel wires, these products being furthermore of substantially lower density.

To be sure, it is known to produce organic monofilaments of high linear density by molten spinning techniques from semi-crystalline linear polymers such as PET or nylon (see, for instance, U.S. Pat. No. 3,650,884, GB-A-1,430,449, EP-A-306,522), but their mechanical properties are moderate and their resistance to temperature limited. It is also known to produce such monofilaments by spinning and drawing polymers or polymer gels of high molecular weight, such as polyethy (EP-A-115,192): these techniques can lead to the obtaining of monofilaments of very high mechanical properties but the weak point of which resides in their very limited resistance to temperature as a result of particularly low melting points.

It was therefore highly desirable to produce monofilaments of large diameter and high mechanical strength from aromatic polyamides in view of the high thermal and chemical resistance of these types of polymers.

The object of the invention is to propose an aramid monofilament having both a large diameter and high mechanical properties in the as spun state.

The aramid monofilament in accordance with the invention is characterized by the following relationships:

$1.7 \leqq Ti \leqq 260$;

$40 \leqq D \leqq 480$;

$T \geqq 170 - D/3$;

$Mi \geqq 2000$;

Ti being the linear density in tex, D being the diameter in μm (micrometer), T being the tenacity in cN/tex, and Mi being the initial modulus in cN/tex for this monofilament.

The invention also concerns a method which makes it possible to obtain at least one such monofilament.

The method of the invention is characterized by the following steps:

a) a solution is formed of at least one aromatic polyamide such that at least 85% of the amide linkages (—CO—NH—) are joined directly to two aromatic rings, the inherent viscosity V.I(p) of this polyamide or these polyamides being at least equal to 4.5 dl/g, the concentration C of polyamide(s) in the solution being at least 20% by weight, this spinning composition being optically anisotropic in the molten state and at rest;

b) this solution is extruded in a spinneret through at least one capillary the diameter "d" of which is greater than 80 μm, the spinning temperature Tf, that is to say the temperature of the solution upon its passage through the capillary, being at most equal to 105° C.;

c) the liquid jet emerging from the capillary is drawn in a non-coagulating layer of non-coagulating non-coagulating fluid;

d) the drawn liquid vein thus obtained is then introduced into a coagulating medium, the monofilament which is thus in course of formation remaining in dynamic contact with the coagulating medium for the time "t", the temperature of the coagulating medium Tc being at most equal to 16° C.;

e) the monofilament is washed and dried; the diameter D of the dry monofilament which has thus been completed and the time t are related by the following relationships:

$$t = KD^2;\ K > 30$$

t being expressed in seconds and D being expressed in millimeters.

The monofilament of the invention can be used either alone or in the form of assemblies, for instance in order to reinforce articles, in particular articles of plastic and/or rubber, such articles being, for instance, belts, hoses, reinforcement plies and automobile tires, the invention also concerning these assemblies and these articles which have been thus reinforced.

The invention will be easily understood from the examples which follow and the merely diagrammatic figures relating to these examples.

I—TEST METHODS USED

Figure 1:
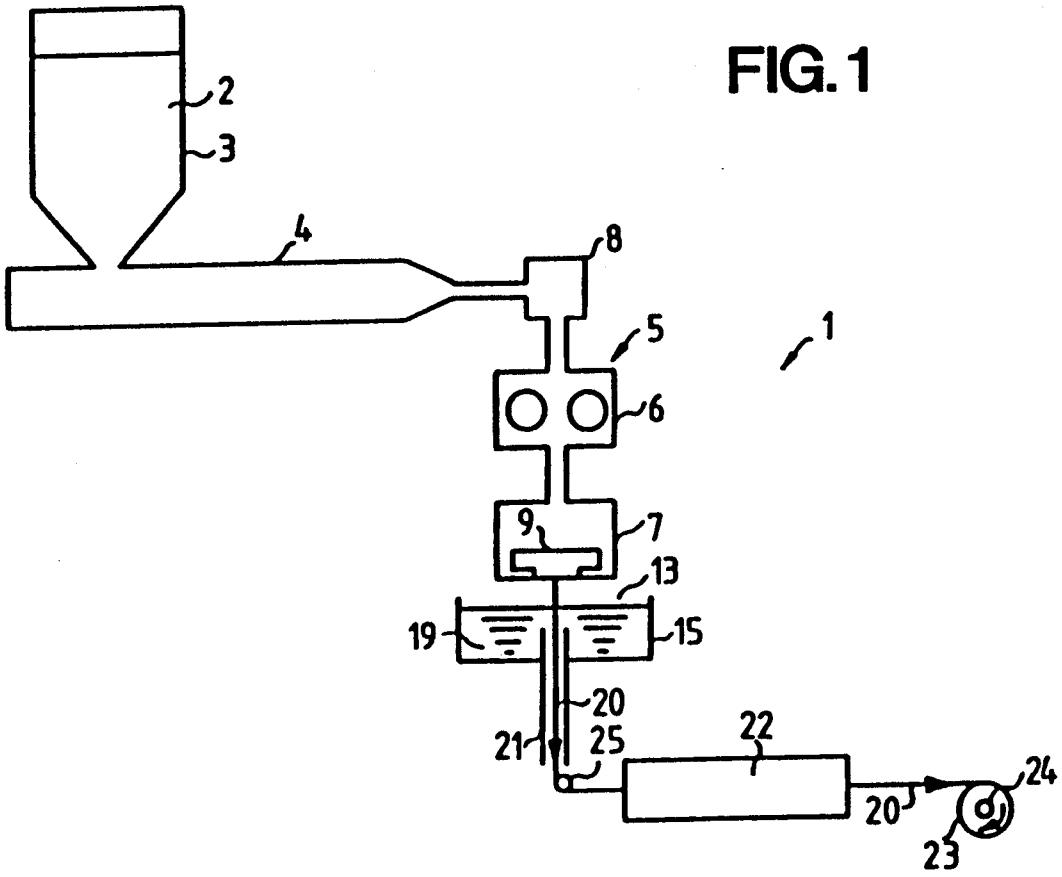
FIG. 1 shows a spinning device for possibly carrying out the method in accordance with the invention.

The expression "spun article" covers any article made by spinning, a monofilament being a particular type of spun article.

A—Conditioning

By conditioning, there is understood in the present description the treatment of the spun articles in accordance with Federal Republic of Germany Standard DIN 53802-20/65 of July 1979.

B—Linear Density

The linear density of the spun articles is determined in accordance with Federal Republic of Germany Standard DIN 53830 of June 1965. The measurement is effected, by weighing for each spun article, on at least three previously conditioned samples, each corresponding to a length of 50 m. The linear density corresponds to the average of the measurements of the samples for the spun article in question; it is expressed in tex.

C—Density

The densities of the spun articles are measured using the density gradient tube technique for plastics specified in ASTM Standard D1505-68 (reapproved in 1975), Method C, using a mixture of 1,1,2-trichlorotrifluoroethane and 1,1,1-tri-chloroethane as liquid system for the density gradient tube.

The samples used are short lengths of about 2 cm of loosely knotted spun articles. Before measurement, they are immersed for two hours in the component of the liquid system which has the lowest density. They then remain in said tube for 12 hours before being evaluated. Particular care is taken to avoid the retention of air bubbles on the surface of the spun articles.

The density is determined in g/cm$^3$ of 2 samples per product, and the average value reported with 4 significant places.

D—Diameter

The diameter of the monofilaments is determined by calculation from the linear density of the monofilaments and their density by the formula:

$$D = 2 \times 10^{1.5} (Ti/\pi\rho)^{\frac{1}{2}}$$

D representing the diameter of the monofilaments in μm, Ti representing the linear density in tex, and ρ representing the density in g/cm$^3$.

E—Mechanical Properties

The mechanical properties of the spun articles are measured by means of a traction machine from Zwick GmbH & Co (Federal Republic of Germany), Type 1435 or Type 1445, corresponding to Federal Republic of Germany Standards DIN 51220 of Oct. 1976, DIN 51221 of Aug. 1976 and DIN 51223 of Dec. 1977, in accordance with the procedure described in DIN 53834 of Jan. 1979.

The spun articles are subjected to traction over an initial length of 400 mm. All the results are obtained with an average of 10 measurements.

The tenacity (T) and the initial modulus (Mi) are indicated in cN/tex (centinewton per tex).

The elongation upon rupture (Ar) is indicated in percentage (%).

The initial modulus (Mi) is defined as the slope of the linear part of the curve representing the variations of the force as a function of the elongation, this linear part being present just after the standard pretension of 0.5 cN/tex.

F—Inherent Viscosity

The inherent viscosity (V.I) is determined for the polymer and the spun articles. V.I(p) represents the inherent viscosity of the polymer, and V.I(f) that of the spun article. In both cases, it is expressed in deciliters per gram and defined by the equation:

$$V.I=(1/C)\ Ln\ (t_1/t_o)$$

in which

C is the concentration of the polymer solution (0.5 g of polymer or of spun article in 100 $cm^3$ of solvent). The solvent is 96% concentrated sulfuric acid.

Ln is the natural logarithm.

$t_1$ and $t_o$ represent the flow time of the polymer solution and the pure solvent respectively, at 30°±0.1° C. in a Ubbelohde capillary viscosimeter.

G—Analysis by X-ray Diffraction and by Electronic Diffraction a) X-Rays: Apparatus and Experimental Set-Up The diffractometric analyses are carried out by means of a high-power Rigaku RU 200Z X-ray generator equipped with:

a rotating anode operating under 40 kV and 200 mA, delivering the Kα line of copper after elimination of the Kβ line by nickel filter and of the white background by energy discrimination;

a Rigaku wide-angle horizontal goniometer (radius 180 mm) equipped with an Euler circle and a scintillation counter. Selection at the collimation level of the X-ray beam:

divergence: point collimator of 1 mm diameter analysis two crossed slits of an angular opening of 1 degree at 170 mm from the sample plane;

a Hewlett-Packard 216 microcomputer assuring the piloting of the goniometer and the acquisition of the data.

b) Determination of the Parameter Aloha

The parameter alpha will be defined further below for the monofilaments of poly(p-phenylene terephthalamide).

Upon the determination of this parameter, the X-ray equatorial diffraction patterns are recorded in symmetric transmission on one or more monofilaments assembled in parallel and arranged vertically. The recording is effected from 13° to 33° in 2 θ (2 theta) by increment of 0.08° and counting time of 10 sec. The calculation of the average intensity of the first five and last five points of the recording makes it possible, after interpolation, to determine and draw a base line (or linear background) used for the measurement of the intensity of certain peaks.

c) Analysis by Electronic Diffraction

A JEOL type JEM 100CX electronic transmission microscope under an acceleration voltage of 120 kV is used.

The electronic microdiffraction observations are carried out on sagittal and longitudinal sections the thickness of which is less than 100 nm. The technique used is the so-called "convergent beam" technique. This technique, as well as the method of regulating the apparatus, were described by M. J. Witcomb (Ultramicroscopy 7, 1982—pp 343—350). The condenser diaphragm has a diameter of 20 μm, the first condenser lens is excited in "spot size 3" position. The diameter of the beam at the level of the sample is close to 400 nm. In order to preserve the crystalline structure during the observation, the microscope is used under conditions of low-dose radiation, low condenser current and without focusing of the second condenser lens. The microdiffraction pictures are recorded on Agfa type 23D56 film.

H—Optical Characteristics

The optical anisotropy of the spinning compositions in the molten state and at rest is observed by means of an Olympus BH2 polarization microscope equipped with a hot stage.

II—COMPARATIVE TESTS ON MONOFILAMENTS OF POLY(P-PHENYLENE TEREPHTHALAMIDE)

The purpose of the following tests is to describe and compare the methods for the obtaining of the monofilaments, as well as the monofilaments themselves when they are in accordance with the invention and not in accordance with the invention. In all of these examples, the polymer used is a poly(p-phenylene terephthalamide).

A—Production of Monofilaments in Accordance with the Invention a) Polymer

The poly(p-phenylene terephthalamide) (PPTA) is prepared by the following known method: a solution of N-methyl-pyrrolidone containing a percentage by weight of calcium chloride of more than 5% is introduced into a mixer which is swept by a stream of nitrogen and equipped with an agitator and a cooling device. The p-phenylene diamine is then added under agitation. After the dissolving of the diamine, the contents of the mixer are cooled to about 10° C. The crushed terephthaloyl dichloride is then added in substantially stoichiometric proportion and the agitation is continued. All of the reagents used are at room temperature (about 20° C.) before introduction into the reactor. Upon completion of the reaction, the mixer is emptied and the product obtained is coagulated with water, washed and dried.

b) Preparation of the Solution

The spinning solution is prepared by the following known method:

Concentrated sulfuric acid of a concentration by weight of acid close to 100% is introduced into a planetary mixer the double jacket of which is connected to a cryostat. Under agitation and a stream of nitrogen, the acid is cooled to a temperature which is at least 10° C. less than its crystallization temperature; the agitation is continued until the formation of a homogeneous mass having the appearance of snow.

The polymer is then added; the temperature of the latter before introduction into the mixer is not critical;

the polymer is preferably at room temperature. The mixing of the acid and the polyamide is effected with agitation, maintaining the temperature of the mixture at a value of 10° C. less than the crystallization temperature of the acid until sufficient homogeneity is obtained. The temperature in the mixer is then progressively increased to room temperature while agitating. A non-cohesive, solid, dry powder is thus obtained.

In the case of a discontinuous process, this solid solution can be kept at room temperature without danger of degradation before the spinning operation. However, prolonged exposure to a humid atmosphere is to be avoided.

In practice, for the carrying out of the tests described below, the amount of polymer necessary to obtain the desired concentration is generally mixed with 8 kg of sulfuric acid. Before the spinning operation, a sample of the solution is taken and weighed. It is then coagulated, washed carefully with water, dried in vacuum, and weighed in order to determine the concentration (% by weight indicated as C hereinbelow) of polymer in the solution.

The spinning compositions described in the present application are optically anisotropic in molten state and at rest, that is to say, in the absence of dynamic stress. Such compositions depolarize light when observed through a microscope between crossed linear polarizers.

c) Spinning

The solutions obtained by the method described in the preceding section are spun by the so-called "non-coagulating gas layer" spinning (or "dry jet-wet spinning technique"). FIG. 1 shows such a spinning device 1.

The solid spinning solution 2, which has been previously deaerated at room temperature in a feed tank 3, is extruded through a single-screw extruder 4 towards the spinning block 5. During this extrusion phase, it is melted under strong shear at a temperature generally between 90° and 100° C.

Prolonged stays at a temperature substantially greater than 100° C. may result in degradation of the polymer, which moreover can be readily checked by an inherent viscosity measurement V.I(f) on the spun article. In front of the block 5 there is therefore generally employed a temperature which is as low as possible but sufficient to assure the fluidity of the solution necessary for its spinning. For these reasons, the temperature of the spinning solution during its transfer towards the spinning block 5 is maintained at a value below 110° C. and preferably below 100° C.

The spinning block 5 is formed essentially of a metering pump 6 and a spinning head 7 through which the liquid solution 2 is extruded. Various elements such as filters and static mixers for instance, may possibly be incorporated in the block 5 or placed at the entrance to the latter, FIG. 1 showing by way of example a filtering device 8. The temperature of the spinning pump 6 is preferably below 100° C. for the same reasons as mentioned previously.

Figure 2:
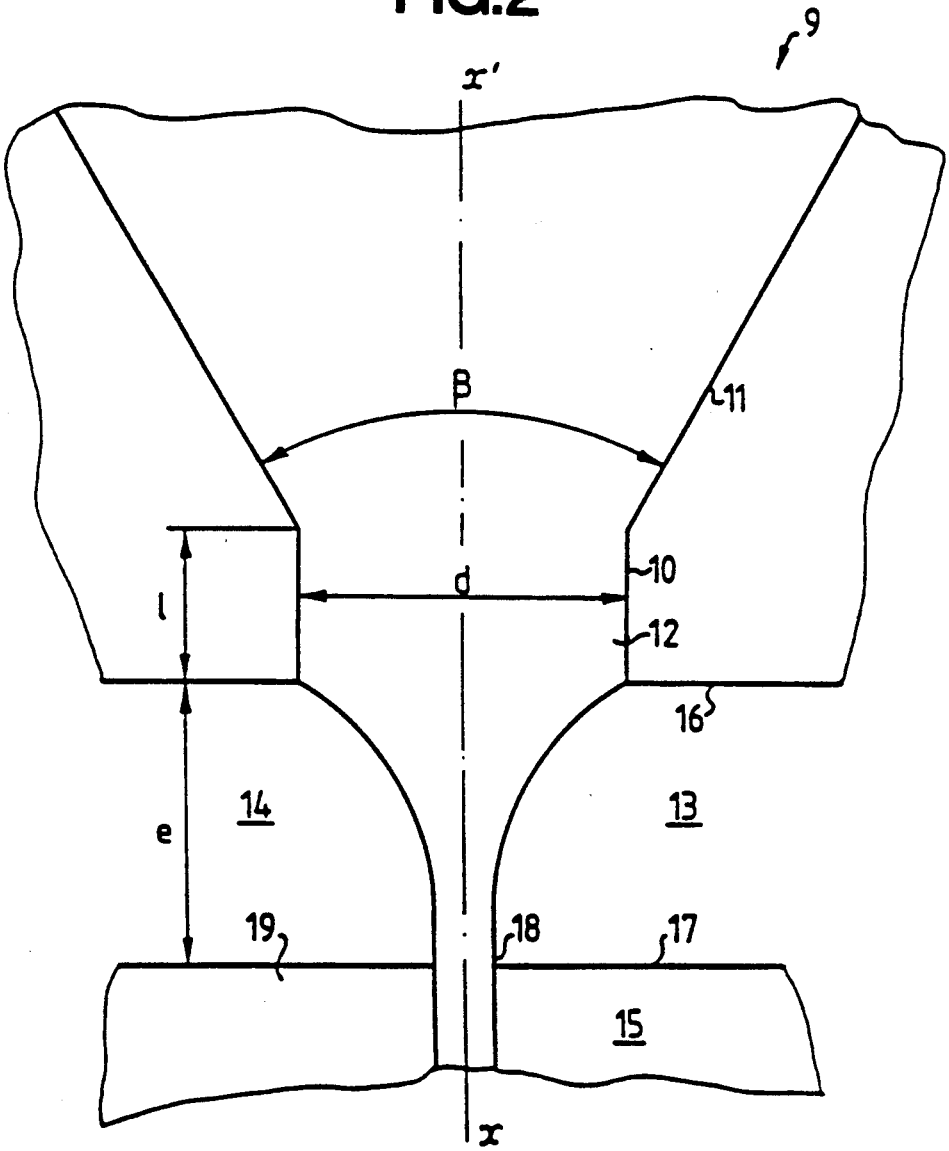
FIG. 2 is a cross-sectional view of a spinneret used in the device shown in FIG. 1.

The spinning head 7 is formed essentially, in known manner, of a distributor, filters, joints and a spinneret. Only the spinneret 9 is shown in FIG. 1 for purposes of simplification, a portion of this spinneret 9 being shown in greater detail in FIG. 2. Ordinarily, as shown in FIG. 2, the spinneret 9 has a single cylindrical capillary 10 of diameter d and length 1, preceded by a convergence 11 of angle $\beta$, the latter being possibly preceded, or not, by a cylindrical counterbore (not shown in FIG. 2), FIG. 2 being a section through the spinneret 9 in a plane passing through the axis xx' of the capillary 10 and d being determined in a plane perpendicular to the axis xx'.

The invention is not limited to the use of a spinneret formed of a single capillary and the method can be extended to the simultaneous spinning of several monofilaments.

The velocity $V_1$ of the jet 12 is the average velocity of passage of the solution 2 in the capillary 10 of the spinneret 9; it can be calculated from the volume of solution 2 passing through this capillary 10 per unit of time.

The spinning temperature Tf is defined as the temperature of the solution 2 upon passage through the capillary 10.

The jet 12 of liquid emerging from the spinneret 9 is drawn in a non-coagulating layer 13 of gas 14, preferably a layer of air, before entering the coagulation bath 15 (FIGS. 1 and 2). The thickness "e" of the layer of air between the outlet face 16 of the spinneret 9, said face being arranged horizontally, and the surface 17 of the coagulation bath 15 may vary from a few millimeters to several tens of millimeters.

After passing through orientation fields developed in the spinneret 9 and in the air layer 13, during which a reorientation has been imparted to the polymer molecules, the drawn liquid vein 18 thus obtained penetrates into the coagulating medium 19 of the bath 15 where one starts to freeze this oriented structure, counteracting in the best way possible the processes of molecular relaxation which occur during the coagulation phase, and this for a longer period of time the larger the diameter of the monofilament to be produced.

In everything that follows, and very generally, there is understood by coagulation the process during which the thread is formed, that is to say, during which the polyamide precipitates or crystallizes, whether it be in solvated state, partially solvated or not solvated. By coagulating medium, there is understood the liquid medium in which such a transformation takes place.

The coagulating medium 19 can be composed, at least in part, of water or substances such as acids, bases or salts or organic solvents, such as for instance, alcohols, polyalcohols or ketones or a mixture of these compounds. Preferably the coagulating medium is an aqueous solution of sulfuric acid.

Upon emergence from the bath 15, the thread 20 in course of formation is entrained with the coagulating medium 19 into the vertical tube 21, the length of which varies for instance from a few centimeters to several tens of centimeters and the inside diameter of which is, for example, a few millimeters, which tube may be straight or constricted, for instance, at its lower end. The association of the coagulation bath 15 and this tube 21, sometimes referred to as "coagulation tube" or "spinning tube", is known to the person skilled in the art for the spinning of conventional aramid fibers. The use of the tube 21 however is not necessary in the device 1.

The depth of coagulating liquid 19 in the coagulation bath 15, measured between the inlet surface 17 of the coagulation bath 15 and the inlet of the spinning tube 21, can vary, for instance, from a few millimeters to several centimeters, too great a depth being capable of impairing the quality of the product in view of the hydrodynamic tensions which may develop, in particular at the highest spinning speeds, upon passage through this first coagulating layer.

One of the essential features of the method of the invention resides in the fact that the dynamic contact times of the thread 20 with the coagulating medium 19 must in most cases be substantially longer than the contact times which can be reached after a single passage through the bath 15 and the spinning tube 21 such as previously described.

These contact times can be lengthened by any suitable means. Rather than using coagulation baths 15 and/or tube 21 of very great depth or length, typically several meters, it is preferred for example—in view, in particular, of the problems of hydrodynamic tension mentioned above—to use at least one additional coagulation device 22 which forms an extension of the bath 15 and the tube 21, said device 22 being placed at the outlet of the spinning tube 21 immediately after a guiding point 25. The device 22 consists, for instance, of baths, pipes and booths in which the coagulating medium 19 flows or of a combination of these various elements, which have not been shown in the drawing in order not to clutter it and the length and configuration of which can be adapted with great flexibility to the specific conditions of production, in particular to the monofilament diameter of the spun product. The thread 20, in course of formation, is preferably subjected to tensions of less than 3 cN/tex.

The total dynamic contact time ("t") of the thread 20 with the coagulating medium 19 is expressed as a function of the square of the monofilament diameter D of the finished product, that is to say the product which has been spun, washed and dried, in accordance with the relationship $$t = KD^2$$

t being expressed in seconds, D being expressed in millimeters and K in second/mm$^2$, K being the so-called "coagulation constant".

By total time of dynamic contact of the thread 20 with the coagulating medium 19 there is understood the entire time during which the monofilament is immersed in the coagulating medium or in contact with said medium upon the passage of the thread 20 in the coagulation devices described above, that is to say the bath 15, the tube 21 and the device 22. These devices must be able to assure an effective renewal of the coagulating medium on the surface of the moving monofilament during the course of formation, the coagulating medium 19 being at the temperature Tc. In this, any supplementary coagulation device such as described above cannot be assimilated to a simple washing device in which one could, for instance, use neutral or basic aqueous solutions at substantially elevated temperature in order to improve the kinetics of extraction of the residual solvent after the coagulation phase.

In the method of the invention, the composition of the coagulating medium 19 and its temperature Tc may be the same or different in the devices 15, 21 and 22.

After the coagulation phase carried out in the devices 15, 21 and 22, the thread 20 formed is washed in order to remove the residual acid which it contains, which washing is carried out optimally by any known means, for instance, by washing with water or even with aqueous alkaline solutions, possibly at high temperature in order to improve the kinetics. This washing may be effected, for instance, by collecting the thread 20 at the outlet of the device 22 on the reel 23 which is driven by the motor 24, this reel being immersed for several hours in a tank which is continuously fed with fresh water.

After washing, the thread 20 is dried, for example on a reel at room temperature or even in an oven, or else by passing the thread over heating cylinders. The drying temperature is preferably equal to at most 200° C.

The device 1 could be so arranged that the washing and drying operations are carried out continuously with the extrusion and coagulation operations.

The dried thread 20 has the diameter D previously defined. The final content in the dry thread 20 of sulfuric acid, or of base if a basic wash liquid is used, is preferably less than 0.01% by weight, referred to the weight of the dry thread.

The spin stretch factor FEF is defined as the ratio of the speed $V_2$ of the first drive device encountered by the thread 20 to the speed $V_1$ of the jet 12 in the capillary 10, this drive device being for instance incorporated in the device 22.

Various additives or substances such as, for instance, softeners, lubricants and products capable of improving the adhesiveness of the product to a gum matrix can possibly be incorporated in the polymer or spinning solution or applied to the surface of the monofilament during the different steps of the method in accordance with the invention which has been described above.

Table 1 below sets forth special conditions of production of monofilaments in accordance with the invention, using the method previously described. This table also gives the diameter D, expressed in μm, of the monofilaments obtained after drying. The table contains 17 series of tests marked A to Q. In these tests one operates in the following manner:

for the dissolving of the polymer, there is used a sulfuric acid of a concentration by weight of acid of between about 99.5 and 100.5%;

the temperature of the extruder 4 and the temperature of the spinning pump 6 are between 90° and 100° C.;

the spinneret 9 has a single capillary, except in the case of series A in which an 8-capillary spinneret is used;

the non-coagulating layer 13 is a layer of air;

the coagulating medium 19 is an aqueous solution of sulfuric acid containing less than 5% by weight of acid;

the spun article is removed directly at the outlet of the coagulation device 22 on the reel 23. The length of monofilament removed on the reel is variable but in all cases more than 1000 m (for instance 4000 to 7000 m in the case of series H and 6000 to 8000 m in the case of series M).

the reels are then immersed for a few hours in a tank which is continuously fed with fresh water for washing, before the drying operation;

the monofilaments which have thus been washed are dried, via an unreeling device, by passage over cylinders heated to a temperature of 140° C. and wound onto a receiving reel, except in the case of tests K-6, K-7and K-9 on the one hand and D-9, D-10, D-11 and D-12 on the other hand, in which the drying is effected in the following manner:

K-6, D-9, D-10, D-11 and D-12: drying on reel at room
temperature (about 20° C.);

K-7: drying on heating cylinders at 90° C.;

K-9 drying on heating cylinders at 170° C.

The abbreviations and units used in Table 1 are as follows:

No: test number;

V.I(p): inherent viscosity of the polymer (in dl/g);
C: concentration of polymer in the solution (% by wt.);
d: capillary diameter of the spinneret (in μm);
1/d ratio of the length of the capillary to its diameter, 1 being the length of the capillary in μm;
β: opening angle of the convergent preceding the capillary (in degrees);
Tf: spinning temperature (in degrees Celsius);
e: thickness of the non-coagulating layer (in mm);
$V_2$: winding speed (in m/min);
FEF: spin stretch factor
Tc: temperature of the coagulating medium (in degrees Celsius);
t: time of dynamic contact with the coagulating medium (in seconds);
K: coagulation constant (in sec $mm^2$);
D: diameter of the monofilament in micrometers (μm).

The method used in these examples is in accord with the invention since the relationships are as follows:

V.I(p)≧4.5 dl/g;
C≧20%;
d>80 μm;
Tf≦105° C.;
Tc≦16° C.;
K>30 sec/$mm^2$

TABLE 1

| No. | V.I(p) | C | d | 1/d | β | Tf | e | $V_2$ | FEF | Tc | t | K | D |
|---|---|---|---|---|---|---|---|---|---|---|---|---|---|
| A-1 | 5.3 | 20.7 | 200 | 1 | 60 | 87 | 10 | 480 | 4.9 | 10 | 4.0 | 1975 | 45 |
| A-2 | " | " | " | " | " | " | " | 300 | " | " | 0.5 | 247 | 45 |
| A-3 | " | " | " | " | " | " | " | " | " | " | 4.0 | 1975 | 45 |
| B-1 | 5.3 | 20.6 | 400 | 2 | 45 | 85 | 10 | 240 | 5.0 | 8 | 8.0 | 988 | 90 |
| B-2 | " | " | " | " | " | " | " | 300 | " | " | " | 988 | 90 |
| B-3 | " | " | " | " | " | " | " | " | 5.1 | " | " | 1033 | 88 |
| B-4 | " | " | " | " | " | " | " | " | " | " | 0.5 | 63 | 89 |
| C-1 | 6.2 | 20.4 | 300 | 2 | 45 | 87 | 10 | 300 | 2.5 | 8 | 6.1 | 690 | 94 |
| C-2 | " | " | " | " | " | " | " | 400 | " | " | 4.6 | 521 | 94 |
| C-3 | " | " | " | " | " | " | " | 500 | " | " | 3.7 | 419 | 94 |
| D-1 | 5.3 | 20.4 | 600 | 2 | 60 | 85 | 10 | 400 | 10.3 | 8 | 4.6 | 532 | 93 |
| D-2 | " | " | " | " | " | " | " | 500 | 10.2 | " | 3.7 | 419 | 94 |
| D-3 | " | " | 400 | 2 | 60 | " | " | 200 | 4.7 | " | 9.2 | 1087 | 92 |
| D-4 | " | " | " | " | " | " | " | 300 | 4.5 | " | 6.1 | 690 | 94 |
| D-5 | " | " | 400 | 2 | 90 | " | " | 200 | " | " | 9.2 | 1041 | 94 |
| D-6 | " | " | " | " | " | " | " | 300 | 4.4 | " | 6.1 | 676 | 95 |
| D-7 | " | " | " | " | " | " | " | 400 | 4.5 | " | 4.6 | 510 | 95 |
| D-8 | " | " | " | " | " | " | " | 500 | 4.7 | " | 3.7 | 428 | 93 |
| D-9 | 6.0 | 20.5 | 400 | 1 | 60 | 84 | 12 | 500 | 3.8 | " | 4.6 | 442 | 102 |
| D-10 | " | " | " | " | " | " | " | 600 | 4.0 | " | 3.8 | 388 | 99 |
| D-11 | " | " | 400 | 7 | 60 | " | " | 500 | 4.2 | " | 4.6 | 479 | 98 |
| D-12 | " | " | " | " | " | " | " | 600 | " | " | 3.8 | 396 | 98 |
| E-1 | 5.4 | 20.1 | 600 | 2 | 60 | 80 | 10 | 300 | 7.6 | 8 | 7.6 | 652 | 108 |
| E-2 | " | 20.4 | " | " | " | " | " | " | 6.8 | " | 6.1 | 461 | 115 |
| E-3 | " | 20.9 | " | " | " | " | " | " | 7.6 | " | " | 504 | 110 |
| F-1 | 5.3 | 20.4 | 400 | 2 | 10 | 85 | 10 | 300 | 2.6 | 8 | 6.1 | 397 | 124 |
| F-2 | " | " | " | " | " | " | " | 400 | " | " | 4.6 | 302 | 123 |
| F-3 | " | " | " | " | " | " | " | 500 | 2.7 | " | 3.7 | 249 | 121 |
| F-4 | " | " | 500 | 2 | 60 | " | " | 300 | 4.1 | " | 6.1 | 403 | 123 |
| F-5 | " | " | " | " | " | " | " | 400 | 4.2 | " | 4.6 | 307 | 122 |
| F-6 | " | " | 800 | 2 | 45 | " | " | 300 | 10.1 | " | 6.1 | 384 | 126 |
| F-7 | " | " | " | " | " | " | " | 400 | 10.3 | " | 4.6 | 299 | 124 |
| G-1 | 5.4 | 20.6 | 800 | 2 | 60 | 80 | 10 | 200 | 7.2 | 8 | 1.0 | 45 | 149 |
| G-2 | " | " | " | " | " | " | " | " | 7.3 | " | 2.0 | 91 | 148 |
| G-3 | " | " | " | " | " | " | " | " | 7.4 | " | 4.7 | 218 | 147 |
| G-4 | " | " | " | " | " | " | " | " | 7.6 | " | 9.2 | 432 | 146 |
| H-1 | 5.4 | 20.6 | 1000 | 2 | 65 | 85 | 12 | 220 | 7.5 | 7 | 10.4 | 311 | 183 |
| H-2 | " | " | " | " | " | " | " | " | 7.6 | 7 | " | 314 | 182 |
| H-3 | " | " | " | " | " | " | " | " | 7.5 | 7 | " | 311 | 183 |
| H-4 | " | " | " | " | " | " | " | " | 8.3 | 13 | " | 340 | 175 |
| I-1 | 5.4 | 20.4 | 1000 | 2 | 60 | 80 | 10 | 220 | 7.8 | 8 | 10.4 | 325 | 179 |
| I-2 | " | 20.7 | " | " | " | " | " | " | 7.5 | " | " | 311 | 183 |
| I-3 | " | 20.9 | " | " | " | " | " | " | 8.2 | " | " | 336 | 176 |
| J-1 | 5.2 | 20.6 | 1000 | 2 | 65 | 75 | 10 | 220 | 7.7 | 9 | 10.4 | 317 | 181 |
| J-2 | " | " | " | " | " | 81 | " | " | 7.6 | " | " | 314 | 182 |
| J-3 | " | " | " | " | " | 86 | " | " | 7.7 | " | " | 321 | 180 |
| J-4 | " | " | " | " | " | 92 | " | " | 7.8 | " | " | 321 | 180 |
| J-5 | " | " | " | " | " | 101 | " | " | 7.7 | " | " | 317 | 181 |
| K-1 | 5.9 | 20.7 | 1000 | 2 | 60 | 85 | 10 | 200 | 6.7 | 8 | 1.5 | 40 | 194 |
| K-2 | " | " | " | " | " | " | " | 220 | 7.5 | " | 4.2 | 125 | 183 |
| K-3 | " | " | " | " | " | " | " | " | 7.1 | " | 8.3 | 253 | 181 |
| K-4 | " | " | " | " | " | " | " | " | 7.5 | " | 10.4 | 311 | 183 |
| K-6 | " | " | " | " | " | " | " | " | 7.6 | " | 8.3 | 251 | 182 |
| K-7 | " | " | " | " | " | " | " | " | 7.6 | " | " | 251 | 182 |
| K-8 | " | " | " | " | " | " | " | " | 7.5 | " | " | 245 | 184 |
| K-9 | " | " | " | " | " | " | " | " | 7.4 | " | " | 243 | 185 |
| L-1 | 5.3 | 20.8 | 600 | 2 | 60 | 85 | 12 | 200 | 2.7 | 8 | 10.4 | 311 | 183 |
| L-2 | " | " | 800 | 2 | 60 | " | " | " | 4.9 | " | " | 314 | 182 |
| L-3 | " | " | 1000 | 2 | 65 | " | " | " | 7.6 | " | " | 311 | 183 |
| L-4 | " | " | 1200 | 2 | 60 | " | " | " | 10.8 | " | " | 307 | 184 |
| L-5 | " | " | 1400 | 2 | 60 | " | " | " | 15.0 | " | " | 314 | 182 |
| M-1 | 5.5 | 20.5 | 1000 | 2 | 60 | 85 | 10 | 220 | 7.8 | 8 | 8.3 | 259 | 179 |
| M-2 | " | " | " | " | " | " | " | " | 7.7 | " | " | 253 | 181 |

TABLE 1-continued

| No. | V.I(p) | C | d | 1/d | β | Tf | e | $V_2$ | FEF | Tc | t | K | D |
|---|---|---|---|---|---|---|---|---|---|---|---|---|---|
| M-3 | 5.5 | 20.7 | " | " | " | " | " | " | 7.5 | " | " | 245 | 184 |
| M-4 | " | " | " | " | " | " | " | " | 7.6 | " | " | 248 | 183 |
| M-5 | 5.3 | 20.7 | " | " | " | " | " | " | 7.7 | " | " | 256 | 180 |
| M-6 | " | " | " | " | " | " | " | " | 7.8 | " | " | 259 | 179 |
| M-7 | 5.6 | 20.7 | " | " | " | " | " | " | 7.6 | " | " | 251 | 182 |
| M-8 | " | " | " | " | " | " | " | " | 7.7 | " | " | 253 | 181 |
| M-9 | " | " | " | " | " | " | " | " | 7.6 | " | 1.4 | 42 | 183 |
| M-10 | " | " | " | " | " | " | " | " | 7.6 | " | 3.4 | 103 | 182 |
| M-12 | 5.8 | 20.4 | 1200 | 2 | 60 | 85 | 10 | 200 | 11.1 | 6 | 11.4 | 352 | 180 |
| M-13 | " | " | " | " | " | " | " | " | " | " | " | 356 | 179 |
| M-14 | 6.2 | 20.3 | " | " | " | 86 | 12 | " | 10.9 | 8 | " | 344 | 182 |
| M-15 | " | " | " | " | " | " | 10 | " | " | " | " | 348 | 181 |
| N-1 | 5.2 | 20.6 | 1000 | 2 | 60 | 85 | 5 | 220 | 7.7 | 8 | 10.4 | 321 | 180 |
| N-2 | " | " | " | " | " | " | 10 | " | " | " | " | " | 180 |
| N-3 | " | " | " | " | " | " | 15 | " | " | " | " | " | 180 |
| N-4 | " | " | " | " | " | " | 20 | " | " | " | " | " | 180 |
| N-5 | " | " | " | " | " | " | 30 | " | " | " | " | " | 180 |
| O-1 | 5.6 | 20.7 | 1400 | 2 | 60 | 76 | 12 | 150 | 10.5 | 9 | 15.2 | 323 | 217 |
| O-2 | " | " | " | " | " | 86 | " | " | 10.3 | " | " | 317 | 219 |
| O-3 | " | " | " | " | " | 91 | " | " | 10.4 | " | " | 320 | 218 |
| P-1 | 5.1 | 20.5 | 1000 | 2 | 65 | 81 | 12 | 220 | 7.9 | 8 | 10.4 | 328 | 178 |
| P-2 | 4.8 | 21.0 | " | " | " | 82 | 10 | 220 | 8.2 | 9 | " | 332 | 177 |
| P-3 | 4.6 | 20.6 | 800 | 2 | 45 | 81 | 12 | 250 | 6.2 | 8 | 9.1 | 351 | 161 |
| P-4 | " | " | " | " | " | " | " | 300 | 7.3 | " | 7.6 | 342 | 149 |
| Q-1 | 5.6 | 20.7 | 1000 | 2 | 65 | 81 | 12 | 130 | 5.1 | 9 | 17.5 | 349 | 224 |
| Q-2 | 5.4 | 20.9 | 1400 | 2 | 60 | 80 | 10 | 140 | 8.0 | 8 | 16.3 | 261 | 250 |
| Q-6 | 5.9 | 20.5 | 1100 | 2 | 65 | 81 | 12 | 100 | 4.8 | 7 | 22.8 | 362 | 251 |
| Q-7 | 5.2 | 20.0 | 1800 | 2 | 60 | 90 | " | 90 | 7.6 | " | 25.3 | 238 | 326 |
| Q-8 | 5.4 | 20.3 | " | " | " | 92 | " | 100 | 5.2 | " | 21.0 | 134 | 396 |

The physical and mechanical properties of the monofilaments obtained are given in the following Table 2, the meaning of the symbols and the units used being as follows:

No: test number;
D: diameter (in μm);
Ti: linear density (in tex);
T: tenacity (in cN/tex);
Ar: elongation upon rupture (in %);
Mi: initial modulus (in cN/tex);
V.I(f): inherent viscosity (in dl/g);
ρ: density (in g/cm³);
alpha: ratio the definition of which is given further below

TABLE 2

| No | D | Ti | T | Ar | Mi | V.I(f) | ρ | alpha |
|---|---|---|---|---|---|---|---|---|
| A-1 | 45 | 2.3 | 158 | 2.62 | 7060 | 5.0 | 1.426 | 0.16 |
| A-2 | 45 | 2.3 | 158 | 2.72 | 6750 | 5.0 | 1.429 | 0.15 |
| A-3 | 45 | 2.3 | 160 | 2.72 | 6876 | 5.0 | 1.429 | 0.15 |
| B-1 | 90 | 9.0 | 146 | 2.65 | 6574 | 5.1 | 1.427 | 0.42 |
| B-2 | 90 | 9.1 | 152 | 2.80 | 6352 | 5.0 | 1.433 | 0.42 |
| B-3 | 88 | 8.8 | 149 | 2.72 | 6580 | 5.0 | 1.433 | 0.42 |
| B-4 | 89 | 8.9 | 142 | 2.54 | 6422 | 5.0 | 1.430 | 0.40 |
| C-1 | 94 | 9.9 | 164 | 3.34 | 6100 | 5.9 | 1.428 | 0.49 |
| C-2 | 94 | 10.0 | 163 | 3.27 | 6210 | 5.9 | 1.428 | 0.50 |
| C-3 | 94 | 9.9 | 160 | 3.24 | 6160 | 5.9 | 1.426 | 0.55 |
| D-1 | 93 | 9.8 | 152 | 3.02 | 6440 | 5.0 | 1.430 | 0.48 |
| D-2 | 94 | 9.9 | 148 | 2.91 | 6330 | 5.1 | 1.430 | 0.49 |
| D-3 | 92 | 9.5 | 164 | 3.55 | 5900 | 5.0 | 1.426 | 0.52 |
| D-4 | 94 | 10.0 | 163 | 3.45 | 6040 | 5.1 | 1.429 | 0.59 |
| D-5 | 94 | 10.0 | 157 | 2.69 | 5320 | 5.1 | 1.426 | 0.54 |
| D-6 | 95 | 10.1 | 159 | 3.55 | 5620 | 5.0 | 1.428 | 0.47 |
| D-7 | 95 | 10.0 | 154 | 3.34 | 5680 | 5.0 | 1.428 | 0.50 |
| D-8 | 93 | 9.6 | 145 | 3.06 | 5850 | 5.0 | 1.428 | 0.49 |
| D-9 | 102 | 11.8 | 149 | 3.07 | 6364 | 5.6 | 1.434 | 0.48 |
| D-10 | 99 | 11.1 | 145 | 2.83 | 6735 | 5.6 | 1.433 | 0.51 |
| D-11 | 98 | 10.8 | 150 | 3.00 | 6706 | 5.6 | 1.434 | 0.49 |
| D-12 | 98 | 10.8 | 139 | 2.78 | 6612 | 5.6 | 1.433 | 0.52 |
| E-1 | 108 | 13.1 | 154 | 3.23 | 5858 | 5.2 | 1.428 | 0.51 |
| E-2 | 115 | 14.8 | 147 | 3.19 | 6082 | 5.2 | 1.428 | 0.58 |
| E-3 | 110 | 13.5 | 140 | 2.88 | 6323 | 5.2 | 1.428 | 0.58 |
| F-1 | 124 | 17.3 | 155 | 3.60 | 5810 | 4.9 | 1.429 | 0.69 |
| F-2 | 123 | 17.0 | 155 | 3.57 | 5890 | 4.9 | 1.428 | 0.71 |
| F-3 | 121 | 16.4 | 145 | 3.30 | 5980 | 5.0 | 1.429 | 0.61 |
| F-4 | 123 | 16.9 | 151 | 3.50 | 5940 | 4.9 | 1.428 | 0.62 |

TABLE 2-continued

| No | D | Ti | T | Ar | Mi | V.I(f) | ρ | alpha |
|---|---|---|---|---|---|---|---|---|
| F-5 | 122 | 16.6 | 144 | 3.30 | 5880 | 4.9 | 1.427 | 0.65 |
| F-6 | 126 | 17.7 | 143 | 3.52 | 5625 | 4.9 | 1.427 | 0.59 |
| F-7 | 124 | 17.3 | 144 | 3.42 | 5780 | 4.9 | 1.428 | 0.65 |
| G-1 | 149 | 25.1 | 124 | 2.95 | 5610 | 5.0 | 1.431 | 0.64 |
| G-2 | 148 | 24.6 | 128 | 3.07 | 5469 | 5.0 | 1.431 | 0.70 |
| G-3 | 147 | 24.3 | 134 | 3.33 | 5387 | 5.1 | 1.431 | 0.69 |
| G-4 | 146 | 23.9 | 143 | 3.40 | 5583 | 5.0 | 1.431 | 0.70 |
| H-1 | 183 | 37.6 | 135 | 3.67 | 4997 | 5.2 | 1.428 | 0.75 |
| H-2 | 182 | 37.2 | 145 | 3.80 | 5025 | 5.2 | 1.428 | 0.75 |
| H-3 | 183 | 37.7 | 138 | 3.69 | 4981 | 5.2 | 1.428 | 0.75 |
| H-4 | 175 | 34.2 | 123 | 3.34 | 5210 | 5.2 | 1.426 | 0.78 |
| I-1 | 179 | 35.7 | 135 | 3.80 | 5014 | 5.1 | 1.424 | 0.75 |
| I-2 | 183 | 37.7 | 133 | 3.75 | 5024 | 5.3 | 1.427 | 0.74 |
| I-3 | 176 | 34.8 | 134 | 3.55 | 5303 | 5.1 | 1.427 | 0.76 |
| J-1 | 181 | 36.8 | 139 | 3.56 | 5557 | 5.0 | 1.427 | 0.73 |
| J-2 | 182 | 37.1 | 139 | 3.67 | 5394 | 5.0 | 1.428 | 0.74 |
| J-3 | 180 | 36.5 | 139 | 3.67 | 5403 | 5.0 | 1.427 | 0.69 |
| J-4 | 180 | 36.4 | 136 | 3.50 | 5510 | 5.0 | 1.428 | 0.67 |
| J-5 | 181 | 36.6 | 110 | 2.94 | 5211 | 5.1 | 1.429 | 0.69 |
| K-1 | 194 | 42.3 | 122 | 3.23 | 5114 | 5.4 | 1.430 | 0.70 |
| K-2 | 183 | 37.8 | 134 | 3.47 | 5155 | 5.6 | 1.430 | 0.72 |
| K-3 | 181 | 37.0 | 138 | 3.49 | 5198 | 5.4 | 1.431 | 0.74 |
| K-4 | 183 | 37.7 | 137 | 3.55 | 5079 | 5.6 | 1.430 | 0.77 |
| K-6 | 182 | 37.2 | 140 | 3.67 | 5298 | 5.4 | 1.430 | 0.73 |
| K-7 | 182 | 37.2 | 139 | 3.58 | 5267 | 5.3 | 1.430 | 0.76 |
| K-8 | 184 | 38.0 | 140 | 3.57 | 5242 | 5.4 | 1.426 | 0.71 |
| K-9 | 185 | 38.3 | 139 | 3.51 | 5284 | 5.5 | 1.426 | 0.72 |
| L-1 | 183 | 37.4 | 134 | 3.53 | 5125 | 5.1 | 1.428 | 0.71 |
| L-2 | 182 | 37.3 | 134 | 3.68 | 5067 | 5.1 | 1.428 | 0.70 |
| L-3 | 183 | 37.5 | 137 | 3.69 | 5117 | 5.1 | 1.428 | 0.71 |
| L-4 | 184 | 38.1 | 137 | 3.75 | 5086 | 5.1 | 1.429 | 0.75 |
| L-5 | 182 | 37.3 | 134 | 3.60 | 5118 | 5.1 | 1.429 | 0.74 |
| M-1 | 179 | 36.0 | 148 | 3.60 | 5348 | 5.3 | 1.426 | 0.72 |
| M-2 | 181 | 36.5 | 148 | 3.69 | 5222 | 5.2 | 1.426 | 0.75 |
| M-3 | 184 | 38.0 | 149 | 3.74 | 5217 | 5.2 | 1.424 | 0.72 |
| M-4 | 183 | 37.4 | 149 | 3.62 | 5381 | 5.3 | 1.424 | 0.72 |
| M-5 | 180 | 36.6 | 148 | 3.54 | 5571 | 4.8 | 1.435 | 0.70 |
| M-6 | 179 | 36.2 | 146 | 3.46 | 5635 | 4.8 | 1.435 | 0.69 |
| M-7 | 182 | 37.5 | 145 | 3.64 | 5232 | 5.0 | 1.434 | 0.69 |
| M-8 | 181 | 37.0 | 148 | 3.62 | 5420 | 5.0 | 1.433 | 0.70 |
| M-9 | 183 | 37.5 | 133 | 3.24 | 5419 | 5.2 | 1.424 | 0.69 |
| M-10 | 182 | 37.3 | 139 | 3.40 | 5416 | 5.2 | 1.432 | 0.69 |
| M-12 | 180 | 36.3 | 158 | 3.93 | 5384 | 5.4 | 1.430 | 0.69 |
| M-13 | 179 | 36.2 | 159 | 3.90 | 5397 | 5.4 | 1.431 | 0.70 |
| M-14 | 182 | 36.9 | 161 | 4.03 | 5391 | 5.6 | 1.425 | 0.70 |
| M-15 | 181 | 36.8 | 164 | 4.11 | 5404 | 5.6 | 1.430 | 0.72 |

TABLE 2-continued

| No | D | Ti | T | Ar | Mi | V.I(f) | ρ | alpha |
|---|---|---|---|---|---|---|---|---|
| N-1 | 180 | 36.5 | 129 | 3.42 | 5296 | 5.1 | 1.432 | 0.73 |
| N-2 | 180 | 36.6 | 134 | 3.48 | 5441 | 5.1 | 1.432 | 0.70 |
| N-3 | 180 | 36.5 | 131 | 3.38 | 5416 | 5.1 | 1.430 | 0.74 |
| N-4 | 180 | 36.5 | 132 | 3.39 | 5454 | 5.0 | 1.432 | 0.72 |
| N-5 | 180 | 36.5 | 117 | 3.23 | 5209 | 5.1 | 1.431 | 0.68 |
| O-1 | 217 | 52.7 | 124 | 3.44 | 5118 | 5.3 | 1.431 | 0.82 |
| O-2 | 219 | 53.7 | 129 | 3.50 | 5199 | 5.2 | 1.430 | 0.85 |
| O-3 | 218 | 53.5 | 127 | 3.51 | 5061 | 5.3 | 1.430 | 0.79 |
| P-1 | 178 | 35.7 | 124 | 3.49 | 5132 | 4.8 | 1.427 | 0.85 |
| P-2 | 177 | 35.2 | 118 | 3.34 | 5103 | 4.6 | 1.427 | 0.80 |
| P-3 | 161 | 29.1 | 125 | 3.43 | 5130 | 4.5 | 1.429 | 0.68 |
| P-4 | 149 | 24.8 | 127 | 3.26 | 5503 | 4.5 | 1.429 | 0.71 |
| Q-1 | 224 | 56.1 | 117 | 3.41 | 4880 | 5.2 | 1.429 | 0.83 |
| Q-2 | 250 | 69.9 | 91 | 2.99 | 4421 | 5.0 | 1.425 | 0.77 |
| Q-6 | 251 | 70.2 | 89 | 3.13 | 4383 | 5.6 | 1.422 | 0.89 |
| Q-7 | 326 | 117.5 | 70 | 2.92 | 3544 | 4.9 | 1.408 | 0.93 |
| Q-8 | 396 | 174.0 | 38 | 2.47 | 2182 | 4.8 | 1.414 | 0.72 |

The monofilaments obtained in accordance with the invention all satisfy the following relationships:

$1.7 \leqq Ti \leqq 260$;

$40 \leqq D \leqq 480$;

$T \geqq 170 - D/3$;

$Mi \geqq 2000$.

The tenacity T and the initial modulus Mi for these monofilaments in accordance with the invention preferably satisfy the following relationships:

$T \geqq 190 - D/3$;

$Mi \geqq 6800 - 10D$.

Even more preferentially, the following relationships are satisfied:

$T \geqq 210 - D/3$;

$Mi \geqq 7200 - 10D$.

It is even noted, for examples M-14 and M-15, that the tenacity T satisfies the relationship:

$T \geqq 220 - D/3$.

Therefore, the monofilaments in accordance with the invention are characterized by high or very high tenacities and by high or very high initial moduli. These initial moduli can be greater than those described for instance in EP-A-021 484 for conventional fibers of small filament diameter. It is surprising to note that the method of the invention not only makes it possible very strongly to orient liquid veins of solution of very large diameter, but also to maintain this orientation at a high or very high level during the coagulation step. It is also noted that these monofilaments in accordance with the invention are characterized by an elongation upon rupture Ar which is at all times more than 2.0% and preferably more than 3.0%, or even more than 4.0%.

It is noted that these monofilaments in accordance with the invention are characterized by high values of inherent viscosity V.I(f), all greater than 4.0 dl/g and equal to or greater than 4.5 dl/g, this inherent viscosity being preferably equal to or greater than 5.0 dl/g.

The spinning of PPTA monofilaments in accordance with the invention leads to a crystalline structure which is different from the structure of a conventional PPTA fiber, this conventional structure being described for instance by M. G. Northolt in Eur. Polym. J., 10, p. 799 (1974).

The crystalline structure of these monofilaments in accordance with the invention can be shown by known X-ray diffraction techniques. An equatorial recording of the X-ray diffraction pattern shows, in an angular range between $2\theta = 13°$ and $2\theta = 33°$ for the copper line $K\alpha$, namely for interplanar spacings; between about 0.270 nm and 0.680 nm, the presence of two additional diffraction lines marked (X) and (Y) in the present application, which are located on opposite sides of and in the vicinity of the two typical reflections of the conventional structure, designated here (A) and (B), these two reflections (A) and (B) being described for example in EP-A-247 889, U.S. Pat. No. 3 869 430, U.S. Pat. No. 4,374,977 and corresponding to the lattice planes (110) and (200) of the poly(p-phenylene terephthalamide) crystal described in particular by Northolt for conventional PPTA fibers. With respect to the two additional peaks, the reference (X) corresponds to the peak appearing on the side of small angles and the reference (Y) corresponds to the peak appearing on the large angle side.

By electronic micro-diffraction analyses carried out on these monofilaments in accordance with the invention, it is noted that the two additional equatorial lines such as defined above are absent from a diffraction pattern recorded at the skin of these monofilaments (that is to say, to a depth of a few micrometers below the surface) and that, in the equatorial range previously indicated, there are only present the two reflections (A) and (B) corresponding to the conventional structure. The PPTA monofilaments in accordance with the invention therefore have a different crystalline structure between the core and the skin.

It is noted that in the case of all the PPTA monofilaments according to the invention, the following relationship is satisfied:

$$alpha \geqq 0.05.$$

alpha being determined by the relationship:

$$alpha = I(X)/I(A),$$

in which I(X) and I(A) are the apparent intensities of the peaks (X) and (A) respectively, that is to say, measured directly on the X-ray diffractogram and corrected merely for the base line.

Figure 3A:
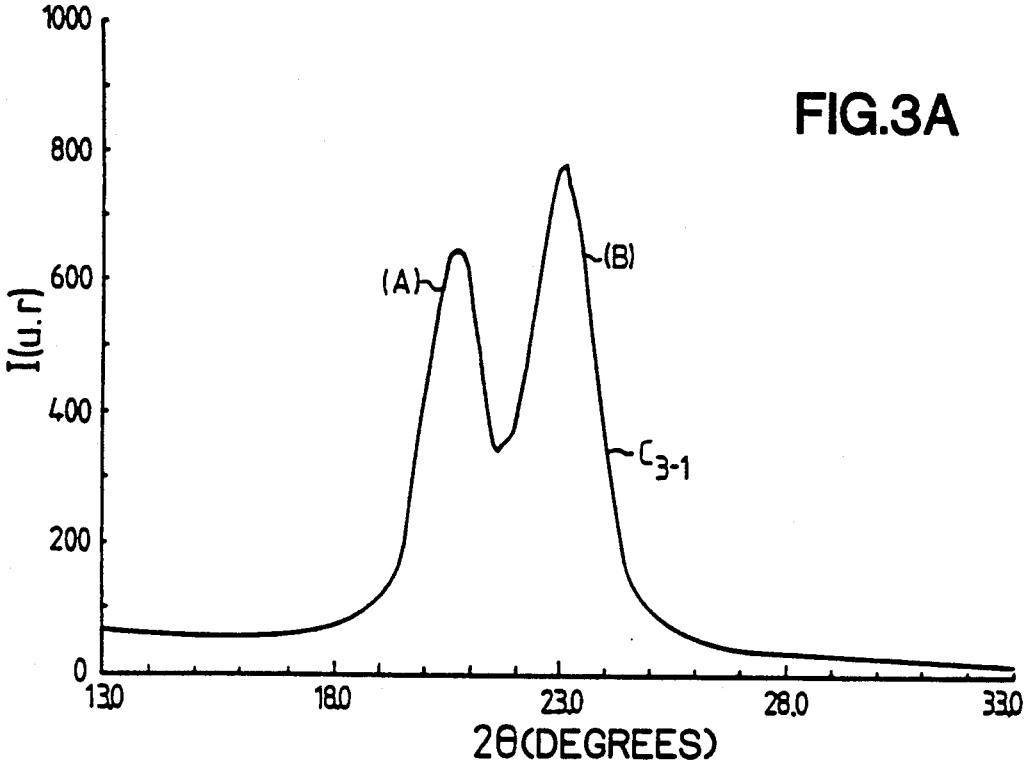
FIG. 3 shows a part of the X-ray equatorial diffraction scans recorded for a known poly(p-phenylene terephthalamide) fiber (PPTA) and for a monofilament in accordance with the invention.
Figure 3B:
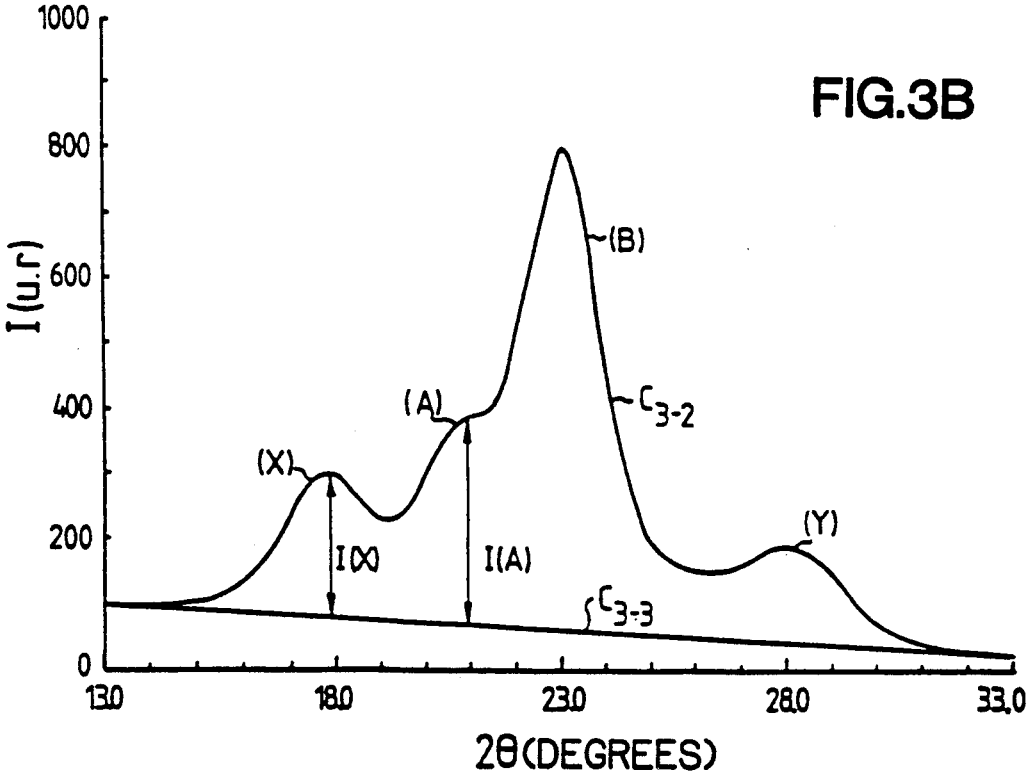

FIG. 3 shows a comparison of the X-ray equatorial diffraction scans recorded for a known PPTA fiber (Kevlar ®49-scan marked $C_{3\text{-}1}$) and for the monofilament in accordance with the invention corresponds to test No. M-7 (scan marked $C_{3\text{-}2}$). In FIG. 3 the angles plotted on the abscissae correspond to $2\theta$ (2 theta) in degrees and the intensity I plotted on the ordinates is expressed in relative units (r.u.).

From FIG. 3 it can be seen that the known fiber does not have the (X) and (Y) lines which are observed on the monofilament in accordance with the invention (scan $C_{3\text{-}2}$). For an X-ray radiation of wavelength 0.1542 nm (copper $K\alpha$ line), the two additional lines (X) and (Y) are in the present case near $2\theta = 18°$ and $2\theta = 28°$ respectively. The two conventional reflections (A) and (B) are positioned in known manner between $2\theta = 19°$ and $2\theta = 25°$ approximately.

The maximum intensities I(X) and I(A) corrected for the base line are shown in FIG. 3 for the scan $C_{3\text{-}2}$, the base line being represented by the line $C_{3\text{-}3}$.

In general, there is noted in the case of these PPTA monofilaments in accordance with the invention an increase in the parameter alpha when the diameter of the monofilament produced increases, in other words an increase in the intensity of the additional line marked (X) to the detriment of the intensity of the conventional reflection marked (A), the intensity of the line marked (B) itself appearing to be comparatively little affected. In the case of the largest monofilament diameters, the decrease in intensity of the peak (A) can be such that the latter no longer appears on the X-ray diffractogram except in the form of a slight shoulder and therefore its angular position can no longer be precisely defined by a simple reading of the recording. The intensity of the peak (A) is then measured at the average angular position known for this peak.

It is seen that for all the monofilaments of these examples in accordance with the invention, the following relationship is satisfied:

$$alpha \geqq 0.70 - exp(-D/80),$$

D being expressed in μm.

It is also noted that these monofilaments in accordance with the invention are characterized by high values of density ρ, which are greater than 1.400 g/cm$^3$, this density being preferably greater than 1 420 g/cm$^3$ and even greater than 1.430 g/cm$^3$, this being the guarantee of a high crystallinity and high structural perfection which are unexpected for such large diameters. It is known that the densities of conventional PPTA fibers of small monofilament diameters are, in the absence of thermal or thermomechanical treatment, generally between 1.400 and 1.450 g/cm$^3$ (see, for example U.S. Pat. No. 3 869 429, U.S. Pat. No. 3 869 430, EP-A-138 011).

The obtaining of these high physical and mechanical properties for the entire range of monofilament diameters between 40 and 480 μm is subject to specific conditions of production which the known technique of spinning conventional multifilament aramid fibers did not make it possible to foresee.

It should be pointed out furthermore that these high properties are obtained directly upon spinning, without further treatment, for instance without thermal, mechanical or thermomechanical treatment of these monofilaments.

In the method of the invention, preferably at least one of the following relationships is satisfied:

V.I(p)≧5.3 dl/g;
C≧20.2%;
Tf≦90° C.;
Tc≦10° C;
K≧200 sec/mm$^2$;
1/d10;
5 degrees≦β≦90 degrees;
3 mm≦e≦20 mm;
2≦FEF≦15.

As previously described, the coagulating medium is advantageous an aqueous sulfuric acid solution.

The inherent viscosities V.I(f) and V.I(p), expressed in dl/g, are preferably related by the equation:

$$V.I(f) \geqq V.I(p) - 0.8,$$

the degradation of the polymer during the different steps of the dissolving, spinning and drying of the fiber thus remaining very limited.

B—Production of Monofilaments Not in Accord with the Invention

PPTA monofilaments are produced in accordance with the general conditions previously described in §II-A, but in such a manner that at least one of the characteristics of the method of the invention is not satisfied.

The precise conditions of the tests thus carried out are set forth in Table 3 below, the abbreviations and units used being the same as for Table 1. Table 3 contains 11 series of tests marked A, B, E, G, H to K, M, P, Q.

In particular, in Examples K-10 and K-11, the temperature Tc of the coagulating medium 19 in the coagulation bath 15 and in the tube 21 is equal to 8° C., but the temperature of this medium in the additional device 22 is equal to 60° C. so that this device 22 is no longer a coagulation device but is used as a conventional washing device such as could furthermore be used in a method of spinning traditional aramid fibers of small monofilament diameter in order to improve the extraction kinetics of the residual solvent. In these Examples K-10, K-11, the time of dynamic contact of the monofilament with the coagulating medium at a temperature Tc of at most 16° C., that is to say, before entrance into the device 22, is only 0.14 sec, which corresponds to a value of K equal to about 4 sec/mm$^2$, which is very low.

Furthermore, in Example M-11 a reel of about 2000 m is removed at the entrance to the additional coagulation device 22, the time of dynamic contact with the coagulating medium being then only about 0.14 seconds, which corresponds to the low value of about 4 sec/mm$^2$ for K.

The properties of the monofilaments obtained are given in Table 4, the abbreviations and the units used being the same as for Table 2.

TABLE 3

| No. | V.I(p) | C | d | 1/d | β | Tf | e | $V_2$ | FEF | Tc | t | K | D |
|---|---|---|---|---|---|---|---|---|---|---|---|---|---|
| A-4 | 5.3 | 20.7 | 200 | 1 | 60 | 87 | 10 | 480 | 5.2 | 10 | 0.025 | 13 | 44 |
| B-5 | 5.3 | 20.6 | 400 | 2 | 45 | 85 | 10 | 240 | 5.0 | 8 | 0.050 | 6 | 90 |
| B-6 | " | " | " | " | " | " | " | 480 | " | " | 0.025 | 3 | 90 |
| E-4 | 5.4 | 18.5 | 600 | 2 | 60 | 80 | 10 | 300 | 6.7 | 7 | 5.2 | 415 | 112 |
| E-5 | " | 19.5 | " | " | " | " | " | " | 7.2 | 10 | 6.1 | 486 | 112 |
| G-5 | 5.4 | 20.6 | 800 | 2 | 60 | 80 | 10 | 200 | 7.2 | 8 | 0.6 | 27 | 149 |
| G-6 | " | " | " | " | " | " | " | " | 7.3 | 25 | 11.4 | 513 | 149 |
| H-5 | 5.4 | 20.6 | 1000 | 2 | 65 | 85 | 12 | 220 | 7.5 | 17 | 10.4 | 311 | 183 |
| H-6 | " | " | " | " | " | " | " | " | 7.8 | 20 | " | 317 | 181 |
| H-7 | " | " | " | " | " | " | " | " | " | 28 | " | 321 | 180 |
| H-8 | " | " | " | " | " | " | " | " | 7.7 | 33 | " | 317 | 181 |
| I-4 | 5.4 | 18.5 | 1000 | 2 | 65 | 80 | 10 | 220 | 6.8 | 7 | 10.4 | 291 | 189 |
| I-5 | " | 19.5 | " | " | " | " | " | " | 7.8 | 10 | 9.1 | 287 | 178 |
| I-6 | " | 19.8 | " | " | " | " | 12 | " | 7.7 | " | 10.4 | 325 | 179 |
| J-6 | 5.2 | 20.6 | 1000 | 2 | 65 | 106 | 10 | 220 | 7.7 | 9 | 10.4 | 317 | 181 |
| J-7 | " | " | " | " | " | 111 | " | " | " | " | " | 314 | 182 |
| J-8 | " | " | " | " | " | 120 | " | " | 7.8 | " | " | 321 | 180 |
| K-5 | 5.9 | 20.7 | 1000 | 2 | 60 | 85 | 10 | 200 | 6.7 | 8 | 0.60 | 16 | 194 |
| K-10 | " | " | " | " | " | " | " | 220 | 7.4 | " | 0.14 | 4 | 189 |
| K-11 | " | " | " | " | " | " | " | " | 7.5 | " | " | 4 | 188 |
| M-11 | 5.6 | 20.7 | 1000 | 2 | 60 | 85 | 10 | 220 | 7.7 | 8 | 0.14 | 4 | 181 |

TABLE 3-continued

| No. | V.I(p) | C | d | 1/d | β | Tf | e | $V_2$ | FEF | Tc | t | K | D |
|---|---|---|---|---|---|---|---|---|---|---|---|---|---|
| P-5 | 4.1 | 21.0 | 1000 | 2 | 65 | 90 | 12 | 220 | 7.9 | 10 | 10.4 | 317 | 181 |
| P-6 | " | 20.2 | 1100 | " | " | 82 | " | " | 9.2 | 8 | " | 321 | 180 |
| P-7 | " | " | " | " | " | 81 | " | 260 | 11.9 | " | 8.8 | 348 | 159 |
| P-8 | 4.4 | 20.7 | " | " | " | 90 | " | 240 | 10.1 | " | 9.5 | 307 | 176 |
| Q-3 | 4.1 | 20.6 | 1000 | 2 | 60 | 81 | 12 | 140 | 4.9 | 10 | 17.6 | 342 | 227 |
| Q-4 | 5.4 | 18.5 | 1400 | 2 | 60 | 81 | 10 | 140 | 7.1 | 8 | 16.3 | 243 | 259 |
| Q-5 | " | 19.5 | " | " | " | " | " | " | 7.6 | 9 | 16.3 | 259 | 251 |

TABLE 4

| No. | D | Ti | T | Ar | Mi | V.I(f) | ρ | alpha |
|---|---|---|---|---|---|---|---|---|
| A-4 | 44 | 2.2 | 136 | 2.67 | 6612 | 5.0 | 1.436 | 0.18 |
| B-5 | 90 | 9.0 | 131 | 2.43 | 6284 | 5.1 | 1.426 | 0.44 |
| B-6 | 90 | 9.1 | 129 | 2.37 | 6493 | 5.2 | 1.428 | 0.48 |
| E-4 | 112 | 13.7 | 56 | 1.76 | 3804 | 5.3 | 1.380 | 0.23 |
| E-5 | 112 | 13.4 | 78 | 2.29 | 4683 | 5.3 | 1.372 | 0.35 |
| G-5 | 149 | 25.1 | 109 | 2.64 | 5546 | 5.1 | 1.430 | 0.60 |
| G-6 | 149 | 24.6 | 64 | 2.40 | 4187 | 5.1 | 1.404 | 0.62 |
| H-5 | 183 | 37.6 | 102 | 3.03 | 4788 | 5.2 | 1.427 | 0.75 |
| H-6 | 181 | 36.2 | 92 | 2.86 | 4720 | 5.2 | 1.407 | 0.73 |
| H-7 | 180 | 36.2 | 66 | 2.57 | 3929 | 5.0 | 1.423 | 0.51 |
| H-8 | 181 | 36.5 | 50 | 2.44 | 3248 | 4.9 | 1.416 | 0.42 |
| I-4 | 189 | 37.2 | 33 | 2.30 | 2118 | 5.3 | 1.330 | 0.38 |
| I-5 | 178 | 34.3 | 47 | 2.39 | 2761 | 5.3 | 1.372 | 0.47 |
| I-6 | 179 | 35.1 | 61 | 2.97 | 2924 | 5.0 | 1.395 | 0.47 |
| J-6 | 181 | 36.7 | 104 | 2.87 | 4879 | 5.1 | 1.429 | 0.68 |
| J-7 | 182 | 36.7 | 84 | 2.70 | 4325 | 5.0 | 1.404 | 0.57 |
| J-8 | 180 | 36.4 | 65 | 2.34 | 3894 | 5.1 | 1.427 | 0.53 |
| K-5 | 194 | 42.1 | 90 | 2.52 | 4781 | 5.5 | 1.428 | 0.74 |
| K-10 | 189 | 38.2 | 55 | 2.61 | 3685 | 5.5 | 1.360 | 0.52 |
| K-11 | 188 | 37.6 | 60 | 2.90 | 3742 | 5.5 | 1.360 | 0.49 |
| M-11 | 181 | 36.9 | 69 | 1.93 | 5132 | 4.9 | 1.430 | 0.74 |
| P-5 | 181 | 36.3 | 55 | 2.40 | 3599 | 3.9 | 1.418 | 0.76 |
| P-6 | 180 | 36.2 | 67 | 2.42 | 3879 | 4.1 | 1.417 | 0.70 |
| P-7 | 159 | 28.1 | 73 | 2.32 | 4215 | 4.1 | 1.418 | 0.69 |
| P-8 | 176 | 34.1 | 94 | 2.94 | 4321 | 4.3 | 1.409 | 0.80 |
| Q-3 | 227 | 57.6 | 59 | 2.57 | 3345 | 3.9 | 2.422 | 0.82 |
| Q-4 | 259 | 70.1 | 26 | 2.81 | 1524 | 5.2 | 1.330 | 0.45 |
| Q-5 | 251 | 68.9 | 36 | 2.92 | 1869 | 5.2 | 1.395 | 0.53 |

From this Table 4, it is noted that the monofilaments obtained not in accordance with the invention all have a diameter D of between 40 and 480 μm but do not satisfy at least one of the ensemble of relationships satisfied by the monofilaments in accordance with the invention. It is furthermore noted that these monofilaments which are not in accordance with the invention have a tenacity which is at all times less and an initial modulus which in most cases is less, than those of the monofilaments in accordance with the invention for an equivalent monofilament diameter.

These monofilaments have the same structural characteristic as the monofilaments in accordance with the invention, that is to say their equatorial X-ray diffraction pattern shows, between $2\theta=13°$ and $2\theta=33°$ (for the copper Kα line), the presence of the two additional diffraction lines marked (X) and (Y), as previously indicated for the monofilaments in accordance with the invention. However, it is noted that these monofilaments which are not in accordance with the invention do not, in a large number of cases, satisfy the preferred relationship alpha 0.70−exp (-D/80) (D being expressed in μm), contrary to the monofilaments in accordance with the invention of the previous examples which systematically satisfy this relationship.

It is also noted that some of these monofilaments which are not in accordance with the invention are characterized by low or very low densities, since they are less than 1.38 g/cm$^3$ and even as low as 1.33 g cm (Examples I-4, Q-4). There are concerned, in particular, monofilaments produced from spinning solutions of concentrations of 18.5 or 19.5%, such concentrations being however typically used for the production of conventional multifilament fibers of a high density of generally between 1.40 and 1.45 g/cm$^3$.

From Tables 1 to 4 it is surprising to note that such small differences in the method of manufacture lead to such great differences on the part of the monofilaments obtained. The production of the monofilaments in accordance with the invention is therefore in accord with specific rules which the known technique of producing multifilaments of small elementum diameter did not make it possible to foresee, as shown with the aid of a few examples in the following chapter.

III—COMPARISON BETWEEN PPTA MONOFILAMENTS AND PPTA Multifilaments

The mechanical properties of the conventional multifilament fibers which appear in the examples which follow were measured under the conditions described in Section I-E, the tractions on these fibers being effected with a preliminary protective twist.

Their density, their inherent viscosity, as well as their X-ray crystalline structure were analyzed in accordance with the methods described in §§ I-C, I-F and I-G respectively.

The spinning solutions used to produce these multifilaments are prepared in the same manner as the solutions used to produce the monofilaments in accordance with Section II-A-b.

A) Influence of the Polymer Concentration in the Spinning Solution on the Tenacity of the Spun Product, on its Density and on its Crystalline Structure On the one hand, monofilaments of a diameter substantially equal to 180 μm are produced in accordance with the conditions described in Sections II-A and II-B (series I), varying the concentration of the polymer in the spinning solution. All the conditions of production are in accordance with the invention with the exception of the concentration C, which can assume values of less than 20% by weight. These conditions, as well as the physical and mechanical properties of the products obtained, have already been given in Tables 1 to 4 above. In the following Table 5 there are simply indicated the test numbers, the linear density Ti and diameter D of the monofilaments obtained and their inherent viscosity V.I(f), and one follows, as a function of the concentration C of the spinning solution, the change in the tenacity T, the density ρ and the parameter alpha obtained from the X-ray analysis. The tenacity is also expressed in relative units (r.u.) taking as base 100 the tenacity obtained on the mono-filaments spun from the least concentrated solution (18.5%).

TABLE 5

| Test No. | C (%) | Ti (tex) | D (μm) | V.I(f) (dl/g) | T (cN/tex) | T (r.u.) | ρ (g/cm$^3$) | alpha |
|---|---|---|---|---|---|---|---|---|
| I-4 | 18.5 | 37.2 | 189 | 5.3 | 33 | 100 | 1.330 | 0.38 |

TABLE 5-continued

| Test No. | C (%) | Ti (tex) | D (μm) | V.I(f) (dl/g) | T (cN/tex) | T (r.u.) | ρ (g/cm³) | alpha |
|---|---|---|---|---|---|---|---|---|
| I-5 | 19.5 | 34.3 | 178 | 5.3 | 47 | 142 | 1.372 | 0.47 |
| I-6 | 19.8 | 35.1 | 179 | 5.0 | 61 | 185 | 1.395 | 0.47 |
| I-1 | 20.4 | 35.7 | 179 | 5.1 | 135 | 409 | 1.424 | 0.75 |
| I-2 | 20.7 | 37.7 | 183 | 5.3 | 133 | 403 | 1.427 | 0.74 |
| I-3 | 20.9 | 34.8 | 176 | 5.1 | 134 | 406 | 1.427 | 0.76 |

On the other hand, from the same polymer batch as used for the preceding monofilaments of an inherent viscosity of 5.4 dl/g, six new solutions of different concentrations C are prepared of between 18.5 and 20 9% by weight of said polymer and conventional multifilament fibers are prepared formed of monofilaments of an average diameter of about 13 μm (filament linear density of 0.18 tex approximately).

The spinning of these multifilaments is carried out in known manner by extrusion of the solution through a spinneret formed of 100 capillaries of a diameter of 50 μm, the spinning temperature being equal to the extrusion temperature (90° C., by drawing through a layer of air of a thickness of 10 mm, the FEF (spin draft facter) being equal to about 4, before passage through the coagulation device consisting of the bath 15 and the associated spinning tube 21, such as described in Section II-A-c, the temperature of the coagulating medium being about 8° C. The spinning speed $V_2$, as defined previously in Section II-A-c, is equal to 400 m/min. The multifilaments spun in this manner are taken from the outlet of the above coagulation device and then washed and dried under the same conditions as those used for the preceding monofilaments.

Table 6 shows the tenacity values T obtained for these multifilaments as a function of the concentration C. There are also indicated the test number, the inherent viscosity V.I(f) and the density ρ of these multifilaments. The tenacity is also expressed in relative units (r.u.) based on 100 for the tenacity measured on the fibers spun from least concentrated solution (18.5%) in accordance with the presentation employed in Table 5.

With respect to the X-ray crystalline structure, the examination of the different multifilaments by the method described in Section I-G does not show any additional line.

Figure 4A:
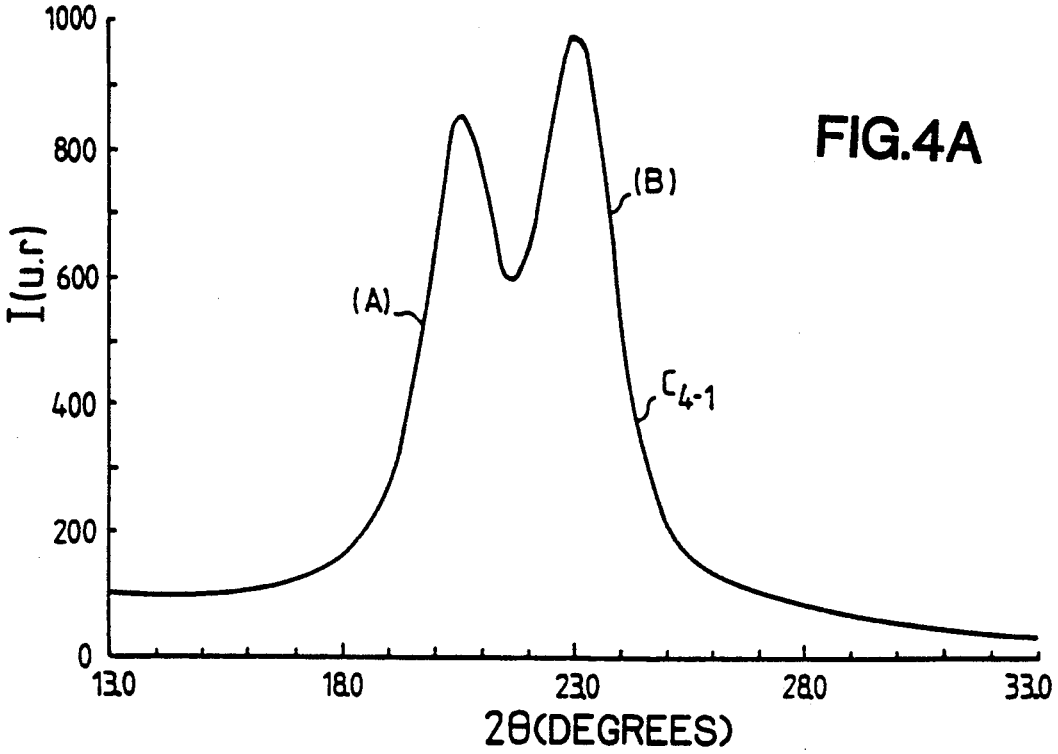
FIG. 4 shows a part of the X-ray equatorial diffraction scans recorded for multifilament fibers of PPTA.
Figure 4B:
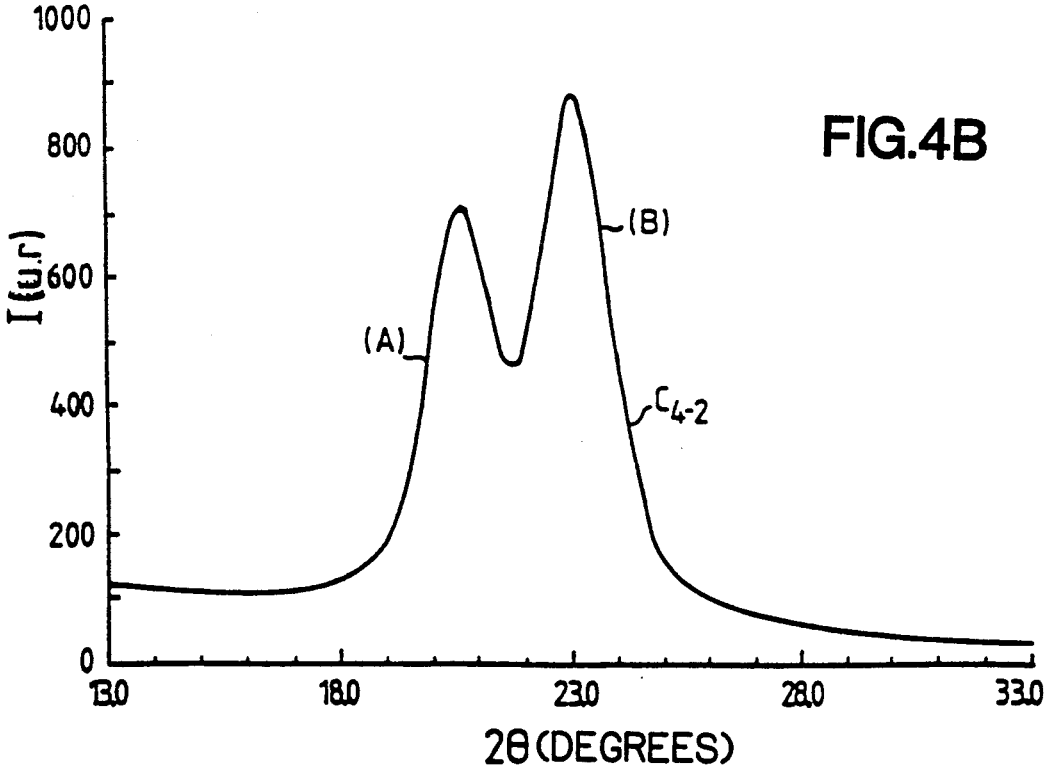

It is therefore verified that the spinning of these conventional multifilament fibers of the tests of series R, in particular from highly concentrated solutions (C≧20%) as used for the production of monofilaments in accordance with the invention, leads to products the X-ray equatorial diffraction scans of which are similar to that of a conventional PPTA fiber; FIG. 4 shows a comparison of such scans, recorded for another known PPTA fiber (Kevlar® 29 - scan marked $C_{4-1}$) and for the multifilament fiber corresponding to test No. R-5 (scan marked $C_{4-2}$). In FIG. 4, the angles plotted on the abscissae correspond to 2θ (2 theta) in degrees and the intensity I plotted on the ordinates is expressed in relative units (r.u.). It is noted that these two scans $C_{4-1}$ and $C_{4-2}$ are analogous and that they are similar to the scan $C_{3-1}$ of FIG. 3, all three being characterized simply by the presence of the two conventional reflections (A) and (B) which have been defined previously.

TABLE 6

| Test No. | C (%) | V.I(f) (dl/g) | T (cN/tex) | T (r.u.) | ρ (g/cm³) |
|---|---|---|---|---|---|
| R-1 | 18.5 | 5.3 | 186 | 100 | 1.443 |

TABLE 6-continued

| Test No. | C (%) | V.I(f) (dl/g) | T (cN/tex) | T (r.u.) | ρ (g/cm³) |
|---|---|---|---|---|---|
| R-2 | 19.5 | 5.3 | 194 | 104 | 1.440 |
| R-3 | 19.8 | 5.2 | 183 | 98 | 1.421 |
| R-4 | 20.1 | 5.3 | 200 | 108 | 1.429 |
| R-5 | 20.4 | 5.3 | 223 | 120 | 1.449 |
| R-6 | 20.9 | 5.2 | 213 | 115 | 1.443 |

Figure 5:
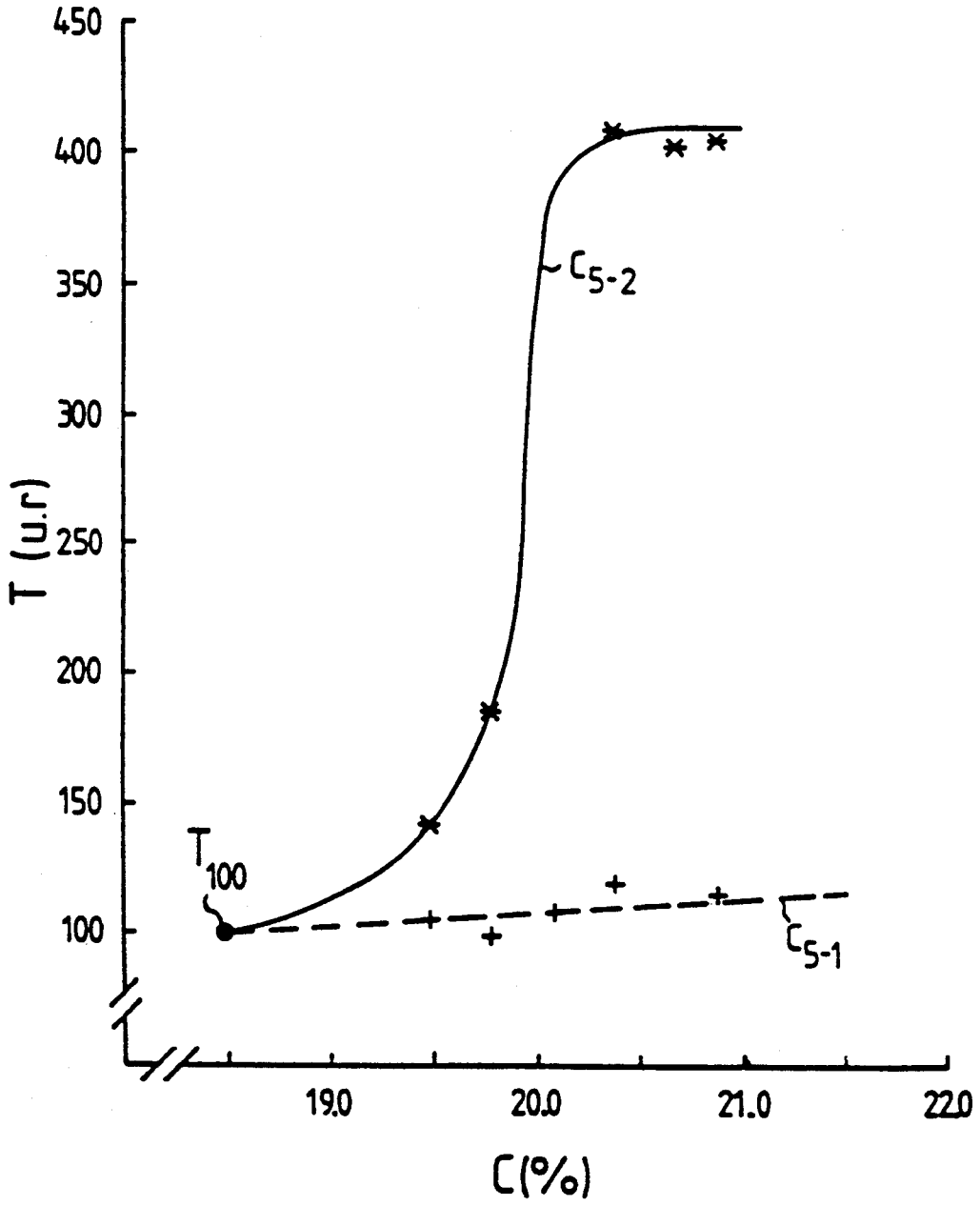
FIG. 5 shows the variation of tenacity, in relative units (r.u.), as a function of the concentration of polymer in the spinning solution, for monofilaments and multifilaments of PPTA.

FIG. 5, which is obtained from Tables 5 and 6, shows, as a function of the concentration C (in %), the variations in tenacity T in relative units (r.u.) for the multifilaments (curve $C_{5-1}$) and for the monofilaments (curve $C_{5-2}$), a common base equal to 100, indicated in FIG. 5 by $T_{100}$, being used for the tenacity obtained on the products spun from the least concentrated solution (C=18.5%). It is noted that the tenacity of the multifilaments is substantially constant, while that of the monofilaments increases very sharply when the concentration reaches and exceeds 20%. The increase in concentration from C=18.5% to 20.4% results in a very remarkable increase of more than 300% in the tenacity of the monofilaments.

From Tables 5 and 6 there is also noted in the case of the monofilaments a strong dependence of the density ρ on the concentration of the spun solution, this not being true in the case of the multifilaments. There is noted in particular the very low density measured on the monofilament spun from the least concentrated solution (test I-4, C=18.5%). This clearly emphasizes the impossibility, in the case of monofilaments of large diameter, of obtaining a highly crystalline structure such as that of traditional aramid fibers from the spinning solutions customarily used for the production of such fibers.

In these comparative tests it is therefore noted that the obtaining of monofilaments in accordance with the invention requires the use of very strongly concentrated solutions and is not in accord with the known rules for the production of conventional aramid fibers having elementary filaments of small diameter. It is known to the person skilled in the art that the concentrations used for the production of such conventional fibers are preferably between 12 and 20% by weight of polymer (see, for instance EP-A-021 484, EP-A-138 011, EP-A-247 889, Ep-A-331 156, U.S. Pat. No. 3 767 756, U.S. Pat. No. 4 340 559 and U.S. Pat. No. 4 726 922), one being even dissuaded from using higher concentrations (see, for instance, U.S. Pat. No. 4 374 977, U.S. Pat. No. 4 374 978, U.S. Pat. No. 4 419 317), in view of their high dynamic viscosity and the difficulties in spinning which may result therefrom.

Furthermore, and entirely unexpectedly, it is noted that in the case of monofilaments the increase in tenacity with the concentration C is accompanied by a very definite increase in the parameter alpha, in other words by a very definite increase in the intensity of the additional line marked (X) to the detriment of the intensity of the conventional reflection (A), as they are defined in Section II-A-c. This clearly emphasizes the existence in the present case of a correlation between the spinning method, the mechanical properties and the particular crystalline structure of the monofilaments. It is noted, in particular that for concentrations of less than 20%, the preferred relationship alpha≧0.70—exp (−D/80) is not satisfied.

B) Influence of the Spinning Temperature on the Initial Modulus and the Tenacity of the Spun Product.

On the other hand, monofilaments in accordance with the conditions given in Sections II-A and II-B (series J) are produced, by varying the spinning temperature Tf by increasing of the temperature of the spinning head 7. These tests are carried out to give monofilaments of the same diameter substantially equal to 180 μm. All the conditions of production are in accordance with the invention except the spinning temperature Tf, which can be greater than 105° C. These conditions, as well as the physical and mechanical properties of the products obtained, have already been given in Tables 1 to 4 above. In the following Table 7 there are set forth only the test numbers, the linear density Ti and the diameter D of the monofilaments and their inherent viscosity V.I(f), and one follows the evolution of the initial modulus Mi and of the tenacity T as a function of the spinning temperature Tf used. The tenacity and the initial modulus are also expressed in relative units (r.u.), taking base 100 for the tenacity and the initial modulus obtained on the monofilaments spun at the lowest spinning temperature (Tf=75° C.).

TABLE 7

| Test No. | Tf (°C.) | Ti (tex) | D (μm) | V.I(f) (dl/g) | T (cN/tex) | T (r.u.) | Mi (cN/tex) | Mi (r.u.) |
|---|---|---|---|---|---|---|---|---|
| J-1 | 75 | 36.8 | 181 | 4.98 | 139 | 100 | 5557 | 100 |
| J-2 | 81 | 37.1 | 182 | 5.00 | 139 | 100 | 5394 | 97 |
| J-3 | 86 | 36.5 | 180 | 5.02 | 139 | 100 | 5403 | 97 |
| J-4 | 92 | 36.4 | 180 | 4.96 | 136 | 98 | 5510 | 99 |
| J-5 | 101 | 36.6 | 181 | 5.05 | 110 | 79 | 5211 | 96 |
| J-6 | 106 | 36.7 | 181 | 5.07 | 104 | 75 | 4879 | 88 |
| J-7 | 111 | 36.7 | 182 | 5.00 | 84 | 60 | 4325 | 78 |
| J-8 | 120 | 36.4 | 180 | 5.06 | 65 | 47 | 3894 | 70 |

As indicated previously, prolonged stays of the spinning solution at elevated temperatures, for instance temperatures substantially above 100° C., may be the cause of degradation of the polymer, which will manifest itself, if the case arises, by a substantial decrease in the inherent viscosity, visible on the spun product, and which may result in a deterioration in the mechanical properties of the latter.

From Table 7 it is noted that the increase in the spinning temperature within the range studied has no effect on the inherent viscosity of the monofilaments; the problem of degradation evoked above therefore does not exist in the present case.

Despite this, it is noted in this series of tests that the tenacity is strongly affected by an increase in the spinning temperature; starting from 106° C., the monofilaments produced are no longer in accordance with the invention. The initial modulus, although it remains high, is also sensitive to this increase of the spinning temperature, the preferred relationship $Mi \geqq 6800-10D$ in particular no longer being verified starting from 106° C.

On the other hand, starting from a polymer of an inherent viscosity equal to 5.5 dl/g and a solution containing 20.0% by weight of said polymer, conventional multifilament fibers formed of monofilaments of an average diameter equal to about 13 μm (linear density of about 0.18 tex) are produced, also varying the spinning temperature Tf within a range in accordance with the preceding one. These fibers are produced in known manner, in accordance with the conditions of production indicated for the tests marked R in Section III-A above.

Table 8 gives the values of the initial modulus Mi and the tenacity T obtained for these multifilaments as a function of the spinning temperature Tf. The initial modulus and the tenacity are also expressed in relative units (r.u.), taking basis 100 for the initial modulus and the tenacity which are obtained on the multifilaments spun at a spinning temperature of 75° C., in accordance with what is set forth in Table 7 above. The test number and the inherent viscosity V.I(f) of the multifilaments obtained are also indicated.

TABLE 8

| Test No. | Tf (°C.) | V.I(f) (dl/g) | T (cN/tex) | T (r.u.) | Mi (cN/tex) | Mi (r.u.) |
|---|---|---|---|---|---|---|
| S-1 | 65 | 5.35 | 225 | 99 | 6330 | 100 |
| S-2 | 75 | 5.36 | 227 | 100 | 6320 | 100 |
| S-3 | 90 | 5.38 | 220 | 97 | 6270 | 99 |
| S-4 | 105 | 5.33 | 217 | 96 | 6510 | 103 |
| S-5 | 120 | 5.32 | 216 | 95 | 6390 | 101 |

From Table 8 it is noted, as in Table 7, that the inherent viscosity of the spun products is not affected by the increase in the spinning temperature.

Furthermore, it is noted that, except for a scarcely noticeable decrease in the tenacity (not exceeding 5%), the mechanical properties of the multifilaments remain practically constant and independent of the spinning temperature within the range studied, contrary to those of the monofilaments.

Figure 6:
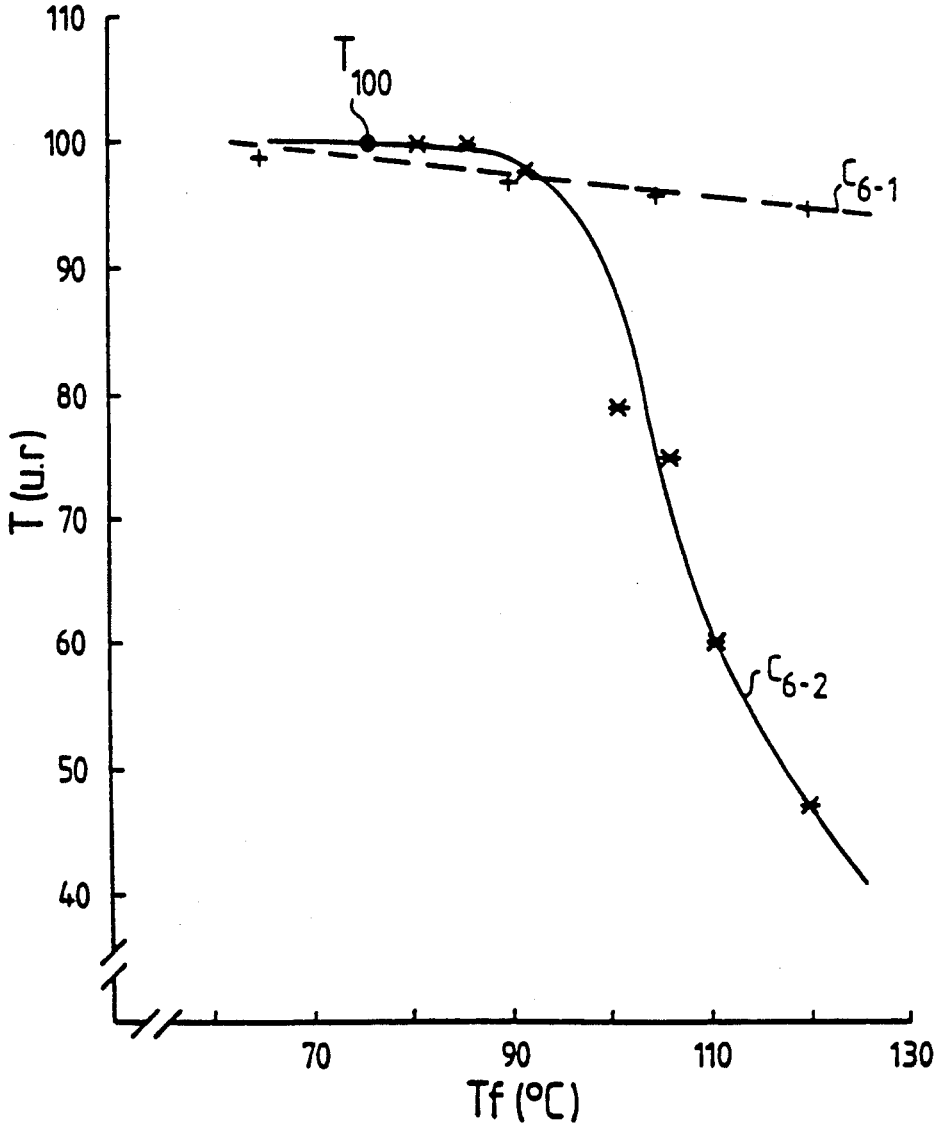
FIG. 6 shows the variation of the tenacity, in relative units (r.u.), as a function of the spinning temperature, for monofilaments and multifilaments of PPTA.
Figure 7:
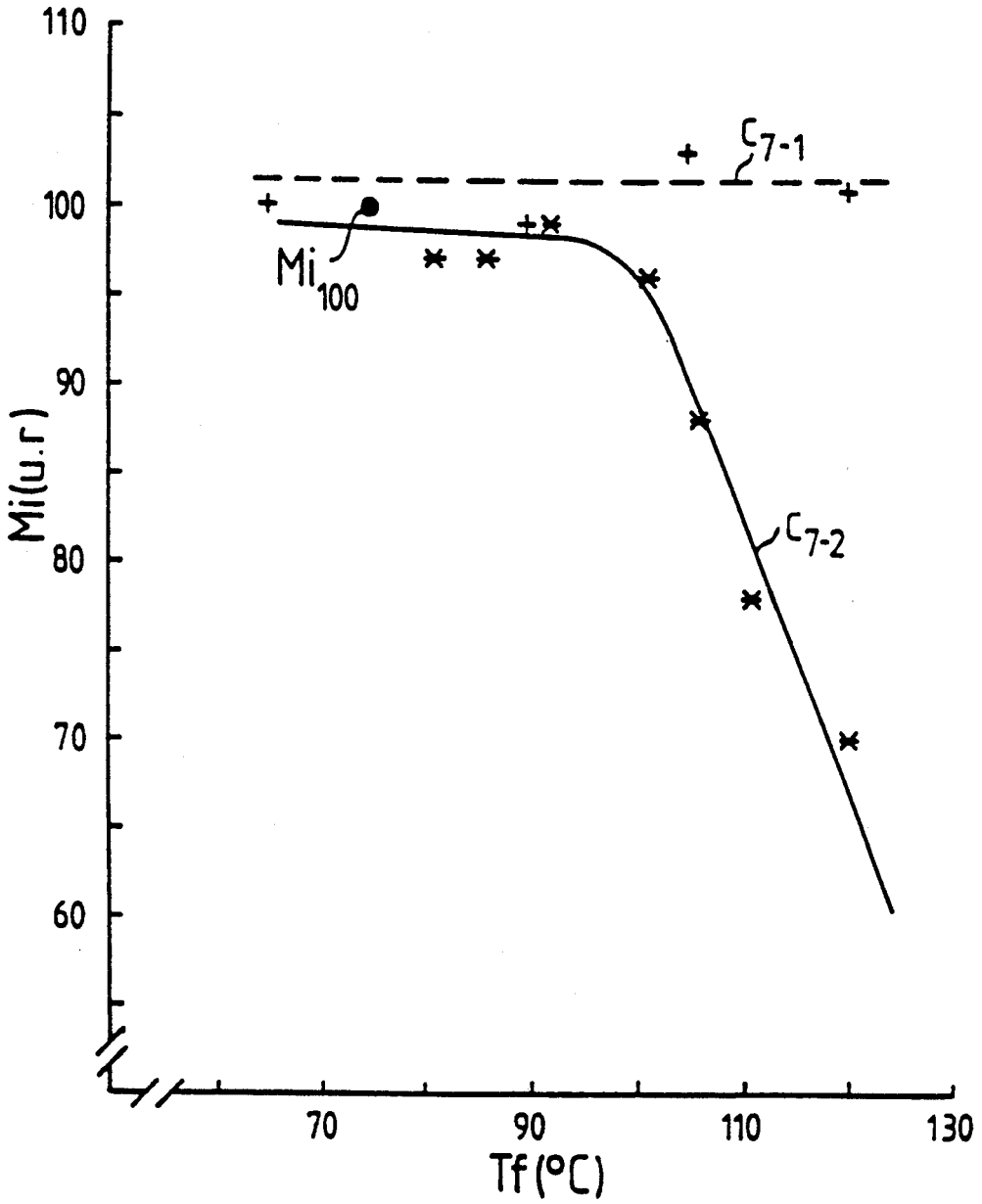
FIG. 7 shows the variation of the initial modulus, in relative units (r.u.), as a function of the spinning temperature, for monofilaments and multifilaments of PPTA.

FIG. 6, which is obtained from Tables 7 and 8, represents, as a function of the spinning temperature Tf, expressed in degrees C, the variations in tenacity T in relative units (r.u.) for multifilaments (curve $C_{6-1}$) and monofilaments (curve $C_{6-2}$) the common base equal to 100, indicated in FIG. 6 by $T_{100}$, corresponds, as previously indicated, to the tenacity obtained on the products spun at a spinning temperature of 75° C. FIG. 7, obtained from the two Tables 7 and 8, illustrates, in its turn, as a function of this same parameter Tf and in the same units, the variations of the initial modulus Mi for multifilaments (curve $C_{7-1}$) and monofilaments (curve $C_{7-2}$), the common base equal to 100 being symbolized in FIG. 7 by $Mi_{100}$, corresponding to the initial modulus obtained on the products spun at a spinning temperature of 75° C.

These results show, once again, that the production of monofilaments in accordance with the invention is governed by specific conditions which the known technique of spinning conventional multifilament fibers did not make it possible to foresee. The use of spinning temperatures which may reach 120° C., for the production of such fibers, is described for example in EP-A-021 484, EP-A-247 889, U.S. Pat. No. 3 767 756, U.S. Pat. No. 3 869 429.

C) Influence of the Temperature of the Coagulating Medium on the Tenacity of the Spun Product On the other hand, monofilaments are produced in accordance with the conditions set forth in Section II-A and II-B (series H), by varying the temperature Tc of the coagulating medium. These tests are carried out in order to produce monofilaments of one and the same diameter substantially equal to 180 μm. All the production conditions are in accord with the invention except for the temperature of the coagulating medium, which may be more than 16° C. These conditions, as well as the physical and mechanical properties of the products obtained have already been given in Tables 1 to 4 above. In Table 9 below, there are simply set forth the test numbers, the linear density Ti, and the diameter D of the monofilaments, their inherent viscosity V.I(f), and the evolution of the tenacity T as a function of the temperature Tc of the coagulating medium can be noted. The tenacity is also expressed in relative units (r.u.) taking the base 100 for the average tenacity obtained on the monofilaments produced from a temperature of the coagulating medium of 7° C. (Examples H-1, H-2 and H-3).

TABLE 9

| Test No. | Tc (°C.) | Ti (tex) | D (μm) | V.I(f) (dl/g) | T (cN/tex) | T (r.u.) |
|---|---|---|---|---|---|---|
| H-1 | 7 | 37.6 | 183 | 5.2 | 135 | |
| H-2 | 7 | 37.2 | 182 | 5.2 | 145 | |
| H-3 | 7 | 37.7 | 183 | 5.2 | 138 | |
| | | | | average value: | 139 | 100 |
| H-4 | 13 | 34.2 | 175 | 5.2 | 123 | 88 |
| H-5 | 17 | 37.6 | 183 | 5.2 | 102 | 73 |
| H-6 | 20 | 36.2 | 181 | 5.2 | 92 | 66 |
| H-7 | 28 | 36.2 | 180 | 5.0 | 66 | 47 |
| H-8 | 33 | 36.5 | 181 | 4.9 | 50 | 36 |

In this series of tests a very great sensitivity of the tenacity to the temperature Tc of the coagulating medium is noted. For temperatures of the coagulating medium which are greater than 16° C., the measured tenacities drop below the threshold in accordance with the invention. The increase in the temperature from 7° to 33° C. results in a loss of tenacity of about 65%.

On the other hand, from the same batch of polymer as used for the preceding monofilaments, of an inherent viscosity equal to 5.4 dl/g, and a solution containing 19.9% by weight of said polymer, conventional multifilament fibers are made, formed of monofilaments of an average diameter equal to about 13 μm (filament linear density of 0.18 tex approximately), also varying the temperature of the coagulating medium within a range in accordance with the preceding one. These fibers are produced in known manner in accordance with the production conditions indicated for the tests marked R and S in the two preceding sections.

Table 10 gives the tenacity values T obtained for these multifilaments as a function of the temperature of the coagulating medium Tc. The tenacity is also expressed in relative units (r.u.) in accordance with the presentation adopted in the preceding table, taking the base 100 for the tenacity obtained on the multifilaments produced, starting from a temperature of the coagulating medium of 7° C. There are also indicated the test number and the inherent viscosity V.I(f) of the multifilaments obtained.

TABLE 10

| Text No. | Tc (°C.) | V.I(f) (dl/g) | T (cN/tex) | T (r.u.) |
|---|---|---|---|---|
| T-1 | 7 | 5.3 | 187 | 100 |
| T-2 | 13 | 5.3 | 180 | 96 |
| T-3 | 21 | 5.3 | 180 | 96 |
| T-4 | 34 | 5.3 | 178 | 95 |

From Table 10 it is noted that the increase in temperature of the coagulating medium from 7° to 34° C. results in the present case only in a very slight loss of tenacity not exceeding 5% as compared with that previously observed for the monofilaments.

Figure 8:
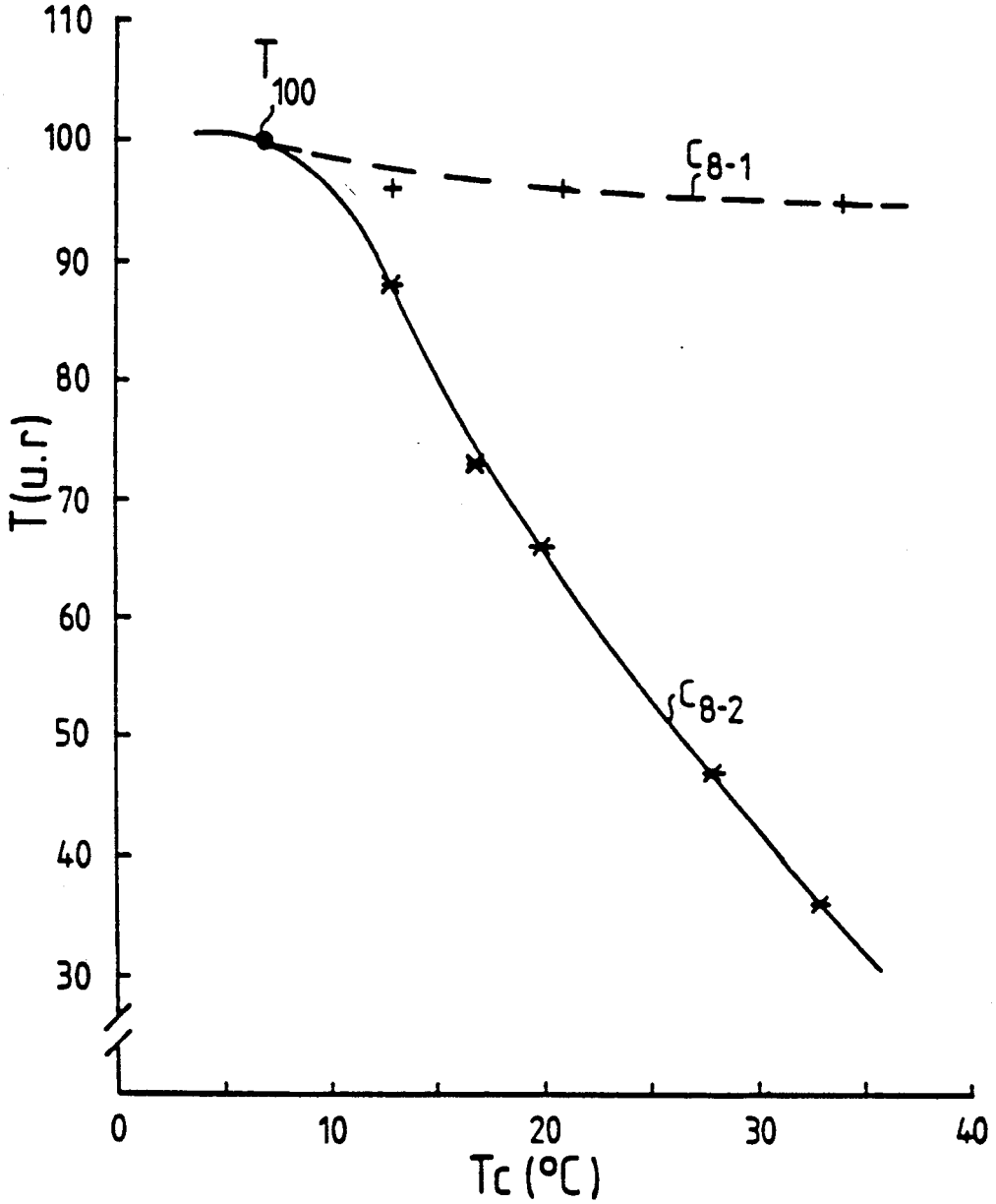
FIG. 8 shows the variation of the tenacity, in relative units (r.u.), as a function of the temperature of the coagulating medium, for monofilaments and multifilaments of PPTA.

FIG. 8, which illustrates these results, shows, as a function of the temperature of the coagulating medium Tc expressed in ° C., the variations of tenacity in relative units (r.u.) for multifilaments (curve $C_{8-1}$) and for monofilaments (curve $C_{8-2}$) the common base equal to 100 indicated in FIG. 8 by $T_{100}$ corresponds to the tenacity obtained on the products produced from the lowest temperature of the coagulating medium, namely 7° C. in the present case.

This figure again shows that the production of monofilaments in accordance with the invention is in accord with rules which are much more restrictive than those for the production of conventional multifilament products. It is known to the person skilled in the art that the temperature of the coagulating medium used for the production of such fibers is not, in general, particularly critical (see, for example, EP-A-021 484, EP-A-247 889, U.S. Pat. No. 3 869 429, U.S. Pat. No. 4 374 977, U.S. Pat. No. 4 419 317), a temperature equal to or greater than 20° C. being even preferred in certain cases (see, for example EP-A-331 156).

D) Influence of the Inherent Viscosity of the Polymer on the Tenacity of the Spun Product On one hand, monofilaments are produced in accordance with the conditions indicated in Sections II-A and II-B (series H, I, J, K, L, M, N, P) by varying the inherent viscosity of the polymer. These tests are carried out to give monofilaments of diameters of between 159 and 183 μm. With the exception of the inherent viscosity of the polymer V.I(p), all the production conditions are in accordance with the invention and furthermore, at the same time, satisfy all the preferred relationships set forth in Section II-A-c. These production conditions, as well as the physical and mechanical properties of the products obtained, have already been given in Tables 1 to 4 above. In Table 11 below, there are simply set forth the test numbers, the linear density Ti and the diameter D of the monofilaments and their inherent viscosity V.I(f), and one notes the evolution of the tenacity T as a function of the inherent viscosity of the polymer V.I(p). The tenacity is also expressed in relative units (r.u.) taking the base 100 for the average tenacity measured on the monofilaments produced from the polymer having the lowest inherent viscosity (V.I(p)=4.1 dl/g; tests P-5, P-6 and P-7).

TABLE 11

| Test No. | V.I(p) (dl/g) | Ti (tex) | D (μm) | V.I(f) (dl/g) | T (cN/tex) | T (r.u.) |
|---|---|---|---|---|---|---|
| P-5 | 4.1 | 36.3 | 181 | 3.9 | 55 | |
| P-6 | 4.1 | 36.2 | 180 | 4.1 | 67 | |
| P-7 | 4.1 | 28.1 | 159 | 4.1 | 73 | |
| | | | | average value: | 65 | 100 |
| P-8 | 4.4 | 34.1 | 176 | 4.3 | 94 | 145 |
| P-3 | 4.6 | 29.1 | 161 | 4.5 | 125 | 192 |
| P-2 | 4.8 | 35.2 | 177 | 4.6 | 118 | 182 |
| P-1 | 5.1 | 35.7 | 178 | 4.8 | 124 | 191 |
| N-2 | 5.2 | 36.6 | 180 | 5.1 | 134 | 206 |
| J-2 | 5.2 | 37.1 | 182 | 5.0 | 139 | 214 |
| M-5 | 5.3 | 36.6 | 180 | 4.8 | 148 | 228 |
| L-3 | 5.3 | 37.5 | 183 | 5.1 | 137 | 211 |
| I-1 | 5.4 | 35.7 | 179 | 5.1 | 135 | 208 |
| H-2 | 5.4 | 37.2 | 182 | 5.2 | 145 | 223 |
| M-2 | 5.5 | 36.5 | 181 | 5.2 | 148 | 228 |
| M-8 | 5.6 | 37.0 | 181 | 5.0 | 148 | 228 |
| M-12 | 5.8 | 36.3 | 180 | 5.4 | 158 | 243 |
| K-6 | 5.9 | 37.2 | 182 | 5.4 | 140 | 215 |
| M-15 | 6.2 | 36.8 | 181 | 5.6 | 164 | 252 |

From Table 11 it is noted that the increase in the inherent viscosity or the polymer V.I(p) from 4.1 to 6.2 dl/g results, in the case of the monofilaments produced, in a very strong increase of the tenacity, which was entirely unexpected since it may even reach into close to 150%.

On the other hand, conventional multifilament fibers are produced, formed of monofilaments of an average diameter of about 13 μm (filament linear density of about 0.18 tex), by also varying the inherent viscosity of the polymer within a range in accordance with the preceding one. These fibers are produced in known manner, in accordance with the production conditions indicated for the tests marked R, S and T in the three preceding sections. Table 12 shows the tenacity values T obtained for these multifilaments as a function of the inherent viscosity of the polymer V.I(p).

The tenacity T is also expressed in relative units (r.u.) in accordance with the presentation adopted in Table 11 for the monofilaments, taking the base 100 for the tenacity measured on the multifilaments produced from the polymer having the lowest inherent viscosity (V.I(p)=4.1 dl/g, test U-1). The test number and the inherent viscosity V.I(f) of the multifilaments obtained are also indicated.

TABLE 12

| Test No. | V.I(p) (dl/g) | V.I(p) (dl/g) | T (cN/tex) | T (r.u.) |
|---|---|---|---|---|
| U-1 | 4.1 | 4.1 | 182 | 100 |
| U-2 | 4.4 | 4.3 | 195 | 107 |
| U-3 | 4.6 | 4.4 | 195 | 107 |
| U-4 | 4.6 | 4.5 | 187 | 103 |
| U-5 | 5.1 | 5.0 | 205 | 113 |
| U-6 | 5.4 | 5.2 | 213 | 117 |
| U-7 | 5.4 | 5.3 | 186 | 102 |
| U-8 | 5.4 | 5.3 | 205 | 113 |
| U-9 | 5.5 | 5.4 | 220 | 121 |
| U-10 | 5.6 | 5.4 | 220 | 121 |
| U-11 | 5.9 | 5.7 | 202 | 111 |

From Table 12 it is noted that the increase in the inherent viscosity of the polymer now results, in the case of the multifilaments produced, only in a very slight increase in the tenacity (not exceeding 21%) as compared with that observed previously in the case of the monofilaments.

Figure 9:
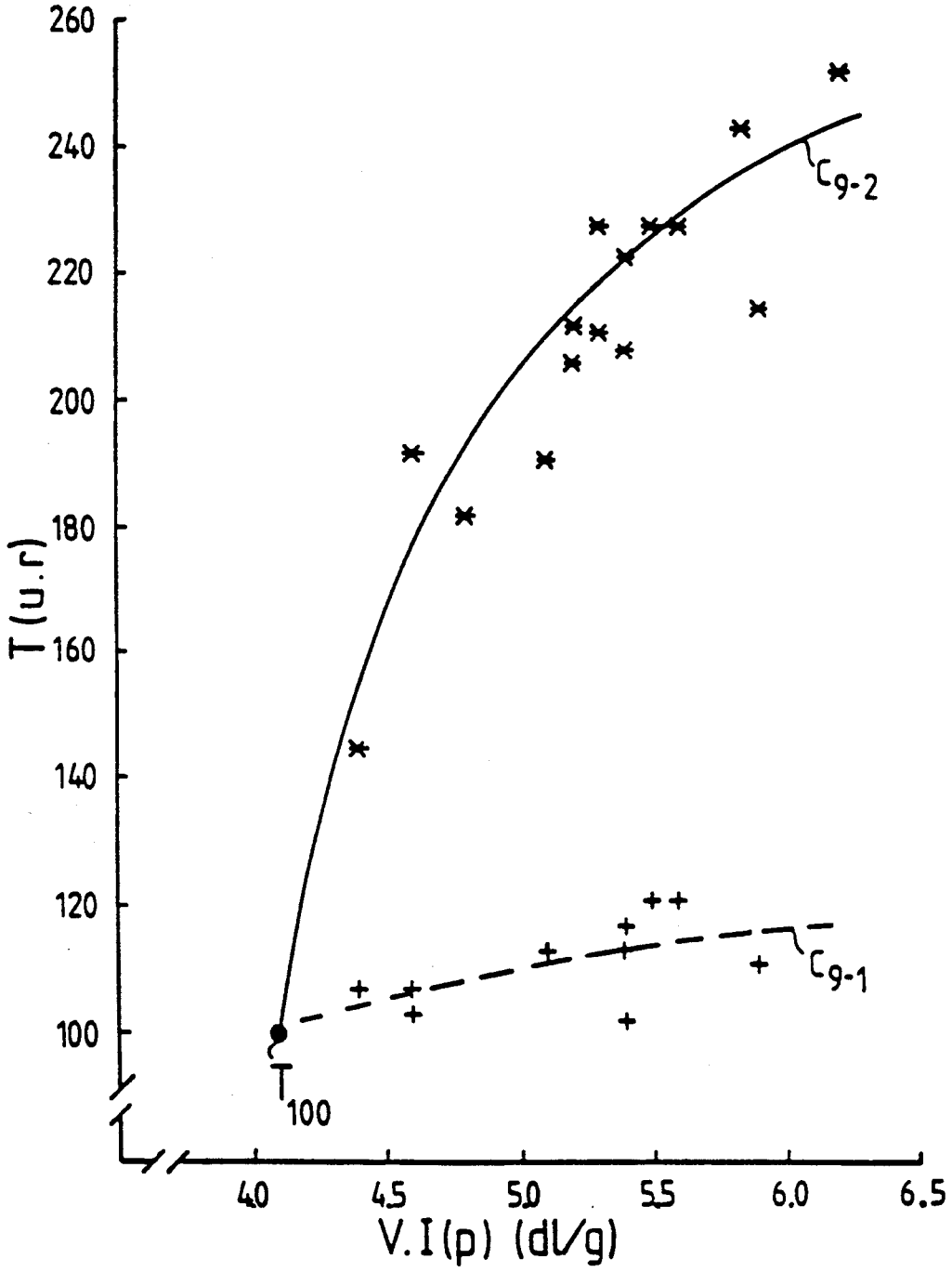
FIG. 9 shows the variation of the tenacity, in relative units (r.u.), as a function of the inherent viscosity of the polymer, for monofilaments and multifilaments of PPTA.

FIG. 9 clearly shows this basic difference in behavior. As a function of the inherent viscosity of the polymer V.I(p), expressed in dl/g, it shows the variations in tenacity in relative units (r.u.) for the multifilaments (curve $C_{9-1}$) and for the monofilaments (curve $C_{9-2}$) the common base equal to 100, indicated in FIG. 9 by $T_{100}$, corresponds to the tenacity measured on the products spun from the polymer having the lowest inherent viscosity, namely 4.1 dl/g in the present case.

These comparative tests show once again, as in the three preceding sections, that the production of the monofilaments of the invention is in accord with rules which are not the known rules for the spinning of conventional aramid fibers. It is known, in particular, to the person skilled in the art to produce such fibers from polymers whose inherent viscosity may be substantially less than 4.5 dl/g (see, for instance EP-A-021 484, EP-A-118 088, EP-A-168 879U.S. Pat. No. 3 767 756, U.S. Pat. No. 4 466 935, U.S. Pat. No. 4 726 922) while assuring very high mechanical properties.

IV—Other Examples of Production of Monofilaments of PPTA in Accordance with the Invention

A—Variations with Respect to the Nature of the Coagulating Medium

As previously indicated in Section II-A-c, the coagulating medium 19 can be composed, at least in part, of water or of substances such as, for instance, acids, bases, salts or organic solvents, or a mixture of these compounds.

In all the examples described up to now, this coagulating medium 19 was a weakly concentrated aqueous sulfuric acid solution containing less than 5% by weight of acid. In this new series of tests, monofilaments of different diameters, all in accordance with the invention, are produced with the use of coagulating mediums of a different composition, by the method in accordance with the invention.

More precisely, the following substances are used in the first coagulation device formed of the bath 15 and the spinning tube 21 associated with it, as they are described in Section II-A-c:

Examples V1 and V2: aqueous solution of sulfuric acid containing 20% by weight of acid, maintained at a temperature of +7° C.

Examples V3 to V5: aqueous solution of sulfuric acid containing 25% by weight of acid, maintained at a temperature of +7° C.

Examples V6 and V7: aqueous solution of sulfuric acid containing 25% by weight of acid, maintained at a temperature of −9° C.

Examples V8 and V9: ethylene glycol maintained at a temperature of −8° C.

Examples V10 to V12: aqueous solution of sulfuric acid containing 35% by weight of acid, maintained at a temperature of +6° C.

In the additional coagulation device 22 the coagulating medium consists of the following substances:

Examples V1 to V9: aqueous solution of sulfuric acid containing less than 5% by weight of acid, maintained at temperature of+7° C.

Examples V10 to V12: aqueous solution of sulfuric acid containing 35% by weight of acid, maintained at a temperature of+6° C. For these last three examples, the composition and the temperature of the coagulating medium therefore remain unchanged as compared with those used in the devices 15 and 21.

For certain embodiments (V6 to V9), it can be noted that the temperature of the coagulating medium Tc is not maintained constant during passage through the devices 15, 21 and 22. Nevertheless, this temperature at all times remains in accord with the invention, since it is at most equal to +7° C.

Aside from the special conditions of preparation indicated above, the monofilaments are produced in accordance with the general conditions described in Section II-A-c. The precise conditions of these tests are set forth in Table 13 which follows, the abbreviations and units used being the same as those indicated in Table 1.

TABLE 13

| No. | V.I(p) | C | d | 1/d | β | Tf | e | $V_2$ | FEF | Tc | t | K | D |
|---|---|---|---|---|---|---|---|---|---|---|---|---|---|
| V-1 | 5.1 | 20.0 | 1800 | 1 | 60 | 81 | 12 | 125 | 8.8 | 7 | 18.2 | 201 | 301 |
| V-2 | " | " | " | " | " | " | " | 110 | 7.4 | " | 20.7 | 192 | 328 |
| V-3 | 5.9 | 20.5 | 1100 | 2 | 65 | 86 | 12 | 100 | 4.7 | 7 | 22.8 | 351 | 255 |

TABLE 13-continued

| No. | V.I(p) | C | d | l/d | β | Tf | e | $V_2$ | FEF | Tc | t | K | D |
|---|---|---|---|---|---|---|---|---|---|---|---|---|---|
| V-4 | " | " | " | " | " | " | " | 150 | 7.2 | " | 15.2 | 358 | 206 |
| V-5 | " | " | " | " | " | " | " | 200 | 9.2 | " | 11.4 | 344 | 182 |
| V-6 | 5.9 | 20.2 | 1100 | 2 | 65 | 85 | 12 | 100 | 4.7 | ≦7 | 22.8 | 353 | 254 |
| V-7 | " | " | " | " | " | " | " | 150 | 7.0 | " | 15.2 | 355 | 207 |
| V-8 | 5.9 | 20.2 | 1100 | 2 | 65 | 86 | 12 | 100 | 4.6 | ≦7 | 22.8 | 345 | 257 |
| V-9 | " | " | " | " | " | " | " | 150 | 6.8 | " | 15.2 | 345 | 210 |
| V-10 | 5.5 | 20.4 | 900 | 1 | 60 | 85 | 12 | 150 | 4.2 | 6 | 15.2 | 314 | 220 |
| V-11 | " | " | " | " | " | " | " | 100 | 2.9 | " | 22.8 | 322 | 266 |
| V-12 | " | " | " | " | " | " | " | 200 | 5.6 | " | 11.4 | 316 | 190 |

The physical and mechanical properties of the monofilaments obtained are given in the following Table 14, the abbreviations and the units used being the same as for Table 2 of Section II-A-c.

TABLE 14

| No | D | Ti | T | Ar | Mi | V.I(f) | ρ | alpha |
|---|---|---|---|---|---|---|---|---|
| V-1 | 301 | 101.0 | 73 | 3.11 | 3412 | 5.0 | 1.420 | 0.86 |
| V-2 | 328 | 120.0 | 69 | 2.95 | 3011 | 5.0 | 1.417 | 0.86 |
| V-3 | 255 | 72.2 | 116 | 3.63 | 4424 | 5.5 | 1.416 | 0.89 |
| V-4 | 206 | 47.5 | 134 | 3.56 | 5224 | 5.5 | 1.420 | 0.88 |
| V-5 | 182 | 36.8 | 137 | 3.45 | 5442 | 5.5 | 1.422 | 0.76 |
| V-6 | 254 | 71.8 | 106 | 3.08 | 4736 | 5.5 | 1.421 | 0.77 |
| V-7 | 207 | 47.8 | 127 | 3.39 | 5071 | 5.5 | 1.423 | 0.85 |
| V-8 | 257 | 73.6 | 114 | 3.75 | 4072 | 5.5 | 1.421 | 0.95 |
| V-9 | 210 | 49.2 | 116 | 3.64 | 4623 | 5.5 | 1.423 | 0.82 |
| V-10 | 220 | 53.9 | 115 | 3.68 | 4433 | 5.0 | 1.421 | 0.86 |
| V-11 | 266 | 78.8 | 92 | 3.53 | 3713 | 4.9 | 1.420 | 0.86 |
| V-12 | 190 | 40.3 | 126 | 3.78 | 4804 | 5.0 | 1.421 | 0.91 |

One might expect that the use of such coagulating media, for instance highly concentrated aqueous sulfuric acid solutions would be incompatible with the production of monofilaments of large diameters and high mechanical properties. This is not true in the method in accordance with the invention. It is even found that in numerous examples of this series of tests the following preferred relationships are complied with:

$T \geqq 190 - D/3$ (for Examples V3 to V8);

$T \geqq 200 - D/3$ (for Examples V3, V4 and V8);

$Mi \geqq 6800 - 10D$ (for Examples V3 to V7);

$Mi \geqq 7200 - 10D$ (for Examples V4 to V6).

As in the examples of monofilaments in accordance with the invention which have been described in chapter II-A, it is noted that the density of the products produced is in all cases greater than 1.400 g/cm$^3$ and at least equal to 1.420 g/cm$^3$ in most of the cases.

It is furthermore noted that the parameter alpha satisfies the preferred relationship observed in the case of the previous examples of PPTA monofilaments in accordance with the invention, namely:

$$\text{alpha} \geqq 0.70 - \exp(-D/80).$$

B—Production of Oblong Monofilaments

The invention is not limited to the use of cylindrical extrusion capillaries, but the method of the invention can for instance be carried out with capillaries of conical shape or with non-circular extrusion holes of different shapes, for instance holes of rectangular or oval shape in order to produce for instance oblong monofilaments. Under these conditions, the definitions of the invention given previously apply very generally, the diameter D representing the smallest dimension of the monofilament and the diameter d the smallest dimension of the extrusion hole, D and d being determined in sections perpendicular to the longitudinal direction of the monofilament and to the direction of flow in the extrusion capillary respectively.

In this section, there are described two examples of the production of oblong monofilaments by extrusion of the spinning solution through capillaries the cross section of which is of ellipsoidal shape.

Except for the geometry of the extrusion capillaries, these oblong filaments are produced in accordance with the general conditions of the invention which have been described in Section II-A-c. The precise conditions of these tests are given in Table 15 which follows, the abbreviations and units used being the same as those of Table 1 subject to the following clarifications and additions:

The parameter d in the present case represents the smallest diameter of the capillary 10, d being determined in a plane perpendicular to the axis xx' shown in FIG. 2. The new parameter d', also expressed in micrometers, in its turn represents the largest dimension of the capillary in this same plane.

The parameter D represents the smallest dimension of the oblong monofilament in a plane normal to the longitudinal direction of said monofilament.

The physical and mechanical properties of the monofilaments obtained are given in Table 16 below, the abbreviations and units used being the same as in the case of Table 2 in Section II-A-c, except for the following clarifications and additions:

The parameter D represents in the present case the smallest dimension of the monofilament, D being no longer determined by calculation as previously but measured in a plane normal to the longitudinal direction of this monofilament.

The new parameter D', also expressed in micrometers, in its turn represents the largest dimension of the monofilament, measured in the same plane.

The measurements of D and D' are effected by optical microscopy on a cross section of the monofilament, this section being directed along a plane perpendicular to the longitudinal direction of said monofilament. In order to facilitate the cutting operation, the monofilament is previously coated in an epoxy resin.

TABLE 15

| No. | V.I(p) | C | d | d' | l/d | β | Tf | e | $V_2$ | FEF | Tc | t | k | D |
|---|---|---|---|---|---|---|---|---|---|---|---|---|---|---|
| W-1 | 5.8 | 20.2 | 800 | 2000 | 4 | 65 | 85 | 4 | 220 | 12.3 | 3 | 10.0 | 756 | 115 |
| W-2 | 5.8 | 20.2 | 400 | 1000 | 4 | 65 | 86 | 112 | 220 | 3.1 | 4 | 10.4 | 615 | 130 |

TABLE 16

| No | D | D' | Ti | T | Ar | Mi | V.I(f) | ρ | alpha |
|---|---|---|---|---|---|---|---|---|---|
| W-1 | 115 | 350 | 36.7 | 141 | 3.46 | 5712 | 5.4 | 1.430 | 0.59 |
| W-2 | 130 | 275 | 36.2 | 135 | 3.50 | 5485 | 5.5 | 1.428 | 0.66 |

V—Other Examples of a Production of Aramid Monofilaments

All the production examples previously described concerned monofilaments of poly(p-phenylene terephthalamide) (PPTA), but the invention applies, very generally, to aramid monofilaments whether or not of PPTA, these aramid monofilaments being produced from aromatic polyamides capable of generating optically anisotropic spinning compositions in the molten state and at rest.

Each aromatic polyamide used in the method of the invention may be a homopolymer or a copolymer, this polyamide having aromatic and possibly nonaromatic units. These units may for instance be formed of radicals or groups of the phenylene, biphenylene, diphenylether, naphthylene, pyridylene, vinylene, polymethylene, polybenzamide or diaminobenzanilide type, which radicals or groups may be substituted or nonsubstituted, the substituents, when present, being preferably non-reactive. This polyamide may possibly contain imide linkages.

The method of the invention may be carried out with a mixture of such polyamides. The monofilaments in accordance with the invention other than of PPTA are preferably formed of copolyamides of the poly(p-phenylene terephthalamide) (PPTA)type. By this expression, there are understood copolyamides having essentially p-phenylene terephthalamide units.

The purpose of the tests which follow is to describe a few embodiments of aramid monofilaments formed by copolyamides of PPTA type, when they are in accordance or not with the invention, as well as the method of obtaining them.

A—Production of Monofilaments in Accordance with the Invention a) Synthesis of the Aromatic Polyamides Used The aromatic polyamides used in these examples are copolyamides having essentially p-phenylene terephthalamide units and additional units of an aromatic or aliphatic nature.

These copolyamides are prepared by the method described in Section II-A-a with the following changes: a molar fraction of p-phenylene diamine (PPDA) or of terephthalic acid dichloride (TADC) is replaced by another diamine or another acid dichloride respectively. The acid chloride or chlorides and the diamine or diamines are in substantially stoichiometric proportions. These substitution monomers are available on the market and are manufactured by known methods, not described here for purposes of simplification. The purity of these monomers is indicated by the suppliers as being greater than 97% and they are used without additional purification.

A total of six different aromatic copolyamides were prepared in accordance with the following scheme:

test series A.A; monomers: PPDA, TADC, adipic acid dichloride (AADC), with 1 mol of AADC to 100 mols of acid dichlorides;

test series A.B; monomers: PPDA, TADC, AADC, with 3 mols of AADC to 100 mols of acid dichlorides;

test series A.C; monomers: PPDA, TADC, m-phenylene diamine (MPDA), with 3 mols of MPDA to 100 mols of diamines;

test series A.D; monomers: PPDA, TADC, fumaric acid dichloride (FADC), with 3 mols of FADC to 100 mols of acid dichlorides;

test series A.E; monomers: PPDA, TADC, 4,4'-diamino-diphenylether (DADPE) with 3 mols of DADPE to 100 mols of diamines;

test series A.F; monomers: PPDA, TADC, 1.5-naphthylene diamine (NDA), with 3 mols of NDA to 100 mols of diamines.

b) Dissolving and Spinning of the Copolyamides

From the above six copolyamides, six spinning solutions are prepared by the method described in Section II-A-b, using a sulfuric acid of a concentration by weight of acid of between about 99.5% and 100.5%.

The solutions obtained are spun according to the invention in accordance with the general conditions and, unless otherwise indicated, in accordance with the special conditions set forth in Section II-A-c for the production of PPTA monofilaments. Table 17 below gives the precise conditions of production of these aramid monofilaments as well as the diameter D of the monofilaments obtained after drying. This Table 17 comprises six series of tests marked A.A, A.B, A.C, A.D, A.E, and A.F.

The abbreviations and units used in this table are the same as those used in Table 1.

In the series of tests A.B, A.D and A.E, the coagulating medium 19 flowing in the devices 15, 21 and 22, such as described in Section II-A-c, is an aqueous sulfuric acid solution containing less than 5% by weight of acid. In the case of test series A.C and A.F, the coagulating medium 19 is a strongly concentrated aqueous sulfuric acid solution since it contains 18% by weight of acid. As for series A.A, there is used as coagulating medium 19 in the devices 15 and 21 an aqueous solution containing 25% by weight of sulfuric acid, maintained at a temperature of −10° C., while in the additional device 22 there is used a solution containing less than 5% by weight of this same acid, at a temperature of +7° C. In this series A.A, the temperature Tc of the coagulating medium is therefore not maintained constant upon passage through the devices 15, 21 and 22; nevertheless, this temperature remains in accord with the invention since it is at most equal to +7° C.

TABLE 17

| No. | V.I(p) | C | d | 1/d | β | Tf | e | $V_2$ | FEF | Tc | t | K | D |
|---|---|---|---|---|---|---|---|---|---|---|---|---|---|
| A.A-1 | 5.5 | 20.1 | 1100 | 2 | 65° | 90 | 10 | 150 | 6.4 | ≧7 | 15.0 | 322 | 216 |
| A.A-2 | " | " | 800 | " | 60 | " | " | 300 | 10.2 | " | 7.5 | 488 | 124 |
| A.A-3 | " | " | " | " | " | " | " | 400 | 11.9 | " | 5.6 | 423 | 115 |
| A.B-1 | 5.7 | 20.1 | 900 | 2 | 60 | 85 | 12 | 100 | 2.9 | 7 | 22.8 | 330 | 263 |
| A.B-2 | " | " | " | " | " | " | " | 150 | 4.2 | " | 15.2 | 320 | 218 |
| A.B-3 | " | " | " | " | " | " | " | 200 | 5.6 | " | 11.4 | 323 | 188 |
| A.C-1 | 5.4 | 20.3 | 900 | 2 | 60 | 85 | 12 | 100 | 2.8 | −6 | 22.8 | 315 | 269 |
| A.C-2 | " | " | 500 | " | " | " | 10 | 100 | 2.5 | −4 | 19.2 | 779 | 157 |

TABLE 17-continued

| No. | V.I(p) | C | d | 1/d | β | Tf | e | $V_2$ | FEF | Tc | t | K | D |
|---|---|---|---|---|---|---|---|---|---|---|---|---|---|
| A.C-3 | " | " | " | " | " | " | " | 200 | 5.0 | " | 9.6 | 779 | 111 |
| A.D-1 | 5.1 | 20.5 | 500 | 2 | 60 | 85 | 12 | 100 | 4.9 | 8 | 22.8 | 1786 | 113 |
| A.D-2 | " | " | 900 | " | " | " | " | 250 | 6.9 | " | 9.1 | 308 | 172 |
| A.D-3 | " | " | " | " | " | " | " | 300 | 8.3 | " | 7.6 | 312 | 156 |
| A.E-1 | 5.1 | 20.4 | 500 | 2 | 60 | 85 | 12 | 100 | 2.6 | 6 | 19.2 | 789 | 156 |
| A.E-2 | " | " | " | " | " | " | " | 150 | 3.8 | " | 12.8 | 781 | 128 |
| A.E-3 | " | " | " | " | " | " | " | 200 | 5.0 | " | 9.6 | 779 | 111 |
| A.F-1 | 5.6 | 20.5 | 900 | 2 | 60 | 90 | 12 | 150 | 4.2 | −5 | 15.2 | 311 | 221 |
| A.F-2 | " | " | " | " | " | " | " | 200 | 5.6 | " | 11.4 | 312 | 191 |
| A.F-3 | " | " | 500 | " | " | " | " | 350 | 8.8 | " | 5.5 | 779 | 84 |

The physical and mechanical properties of the monofilaments obtained, in the as-spun state and therefore after drying, are given in Table 18 below, the meaning of the symbols and the units used being the same as in the case of Table 2.

TABLE 18

| No | D | Ti | T | Ar | Mi | V.I(f) | ρ |
|---|---|---|---|---|---|---|---|
| A.A-1 | 216 | 52.3 | 121 | 3.54 | 4748 | 5.0 | 1.428 |
| A.A-2 | 124 | 17.2 | 140 | 3.51 | 5504 | 4.9 | 1.431 |
| A.A-3 | 115 | 14.8 | 141 | 3.48 | 5465 | 4.9 | 1.432 |
| A.B-1 | 263 | 77.2 | 102 | 3.65 | 3989 | 4.8 | 1.416 |
| A.B-2 | 218 | 53.0 | 120 | 3.88 | 4294 | 4.8 | 1.418 |
| A.B-3 | 188 | 39.5 | 127 | 3.65 | 4881 | 4.8 | 1.418 |
| A.C-1 | 269 | 80.8 | 86 | 3.49 | 3263 | 4.8 | 1.424 |
| A.C-2 | 157 | 27.7 | 157 | 4.21 | 4890 | 4.9 | 1.426 |
| A.C-3 | 111 | 13.9 | 157 | 3.43 | 5952 | 4.9 | 1.432 |
| A.D-1 | 113 | 14.4 | 136 | 3.01 | 5730 | 4.3 | 1.432 |
| A.D-2 | 172 | 33.2 | 123 | 3.37 | 4567 | 4.5 | 1.431 |
| A.D-3 | 156 | 27.4 | 126 | 3.17 | 4941 | 4.5 | 1.431 |
| A.E-1 | 156 | 27.3 | 135 | 4.08 | 4126 | 4.6 | 1.429 |
| A.E-2 | 128 | 18.4 | 144 | 3.83 | 4856 | 4.7 | 1.431 |
| A.E-3 | 111 | 13.9 | 148 | 3.43 | 5688 | 4.8 | 1.432 |
| A.F-1 | 221 | 54.0 | 129 | 3.73 | 4346 | 5.3 | 1.412 |
| A.F-2 | 191 | 40.6 | 139 | 3.63 | 4862 | 5.3 | 1.420 |
| A.F-3 | 84 | 8.0 | 165 | 2.55 | 7490 | 5.3 | 1.429 |

It is therefore noted that these monofilaments in accordance with the invention are characterized by high tenacities and by high or very high initial moduli.

It is furthermore noted that in numerous examples of these test series, the following preferred relationships are satisfied:

$T \geqq 190 - D/3$ for Examples A.A-1, A.B-1 to A.B-3, A.C-2 and A.C-3, A.F-1 to A.F-3.

$T \geqq 200 - D/3$ for Examples A.C-2, A.F-1 and A.F-2.

$Mi \geqq 6800 - 10D$ for Examples A.A-1, A.C-3, A.D-1 and A.F-3.

$Mi \geqq 7200 - 10D$ for Example A.F-3.

The following findings are furthermore made in the case of these monofilaments:

the elongation at rupture Ar is greater than 2%; it is greater than 3% in the majority of the cases and even greater than 4% in the case of Examples A.C-2 and A.E-1;

the density ρ is at all times greater than 1.400 g/cm$^3$; it is even greater than 1.420 g/cm$^3$ in the majority of the cases;

the inherent viscosity V.I(f) is greater than 4.0 dl/g and at least equal to 4.5 dl/g in the majority of the cases.

B—Production of Monofilaments Not in Accord with the Invention

An aromatic copolyamide is prepared in the manner described in section V-A-a above, using the following monomers: PPDA, TADC, 1.5-naphthylene diamine (NDA), with 3 mols of NDA for 100 mols of diamines.

A spinning solution is prepared by the method described in Section II-A-b, using a sulfuric acid of a concentration by weight of acid of about 99.5%. From this solution, monofilaments are prepared in accordance with the general conditions previously described in Section V-A-b but in such a manner that at least one of the characteristics of the method in accordance with the invention is not complied with.

The precise conditions of the tests thus carried out are given in Table 19 below, the abbreviations and units used being the same as in the case of Table 17. This series of tests covers three examples marked A.G-1, A.G-2 and A.G-3, for which the method is no longer in accordance with the invention for the following reasons:

$Tc > 16°$ C., in the case of Example A.G-1

$Tf > 105°$ C., in the case of Example A.G-2

$K < 30$ sec/mm$^2$, in the case of Example A.G-3

TABLE 19

| No. | V.I(p) | C | d | 1/d | β | Tf | e | $V_2$ | FEF | Tc | t | K | D |
|---|---|---|---|---|---|---|---|---|---|---|---|---|---|
| A.G-1 | 5.5 | 20.7 | 1200 | 2 | 60 | 85 | 12 | 200 | 11.1 | 25 | 11.4 | 337 | 184 |
| A.G-2 | " | " | " | " | " | 115 | " | 200 | 10.8 | 6 | " | 337 | 184 |
| A.G-3 | " | " | " | " | " | 85 | " | 300 | 11.0 | 6 | 0.4 | 12 | 183 |

The characteristics of the monofilaments obtained are given in Table 20, the abbreviations and units used being the same as in Table 18.

TABLE 20

| No | D | Ti | T | Ar | Mi | V.I(f) | ρ |
|---|---|---|---|---|---|---|---|
| A.G-1 | 184 | 36.8 | 56 | 2.33 | 3464 | 4.9 | 1,390 |
| A.G-2 | 184 | 37.7 | 78 | 2.69 | 3648 | 4.9 | 1.422 |
| A.G-3 | 183 | 37.0 | 74 | 2.68 | 3814 | 5.0 | 1.406 |

It is noted that these monofilaments have a tenacity which is clearly less than that of the monofilaments in accordance with the invention which have been previously described.

The introduction into the polymer of units other than the p-phenylene terephthalamide units makes the electronic microdiffraction and X-ray diffraction patterns in general more complicated so that one cannot draw as clear conclusions from them with regard to the crystalline structure of the monofilaments obtained as in the case of the PPTA monofilaments.

Of course, the invention is not limited to the embodiments which have been described above.

We claim:

1. An aramid monofilament having the following relationships:

$1.7 \leqq Ti \leqq 260$;

$40 \leqq D \leqq 480$;

$T \geqq 170 - D/3$;

$Mi \geqq 2000$;

Ti being the linear density in tex, D being the diameter in μm (micrometers), T being the tenacity in cN/tex, and Mi being the initial modulus in cN/tex for this monofilament.

2. An aramid monofilament according to claim 1, having the following relationship:

$T \geqq 190 - D/3$.

3. An aramid monofilament according to claim 2, having the following relationship:

$T \geqq 210 - D/3$.

4. An aramid monofilament according to any of claims 1 to 3, having the following relationship:

$Mi \geqq 6800 - 10D$.

5. An aramid monofilament according to claim 4, having the following relationship:

$Mi \geqq 7200 - 10D$.

6. An aramid monofilament according to claim 1, having the following relationship:

$Ar > 2$,

Ar being the elongation upon rupture expressed in % for this monofilament.

7. An aramid monofilament according to claim 6, having the following relationship:

$Ar > 3$.

8. An aramid monofilament according to claim 7, having the following relationship:

$Ar > 4$.

9. An aramid monofilament according to claim 1, having the following relationship:

$\rho > 1.400$,

ρ being its density expressed in $g/cm^3$.

10. An aramid monofilament according to claim 9, having the following relationship:

$\rho > 1.420$.

11. An aramid monofilament according to claim 10, having the following relationship:

$\rho > 1.430$.

12. An aramid monofilament according to claim 1, having the following relationship:

$V.I(f) > 4.0$,

V.I(f) being its inherent viscosity expressed in dl/g.

13. An aramid monofilament according to claim 12, having the following relationship:

$V.I(f) \geqq 4.5$.

14. An aramid monofilament according to claim 13, having the following relationship:

$V.I(f) \geqq 5.0$.

15. An aramid monofilament according to claim 1, comprising essentially p-phenylene terephthalamide units.

16. An aramid monofilament according to claim 1, comprising poly-(p-phenylene terephthalamide) (PPTA).

17. An aramid monofilament according to claim 16, in which an equatorial recording of its X-ray diffraction pattern shows, in an angular range between $2\theta = 13°$ and $2\theta = 33°$, for the copper Kα line, the presence of four peaks marked, in accordance with the increase in the angles 2θ, (X), (A), (B), (Y), and by the fact that there is the relationship:

$alpha \geqq 0.05$ with, by definition, alpha = I(X)/I(A), I(X) and I(A) being the apparent maximum intensities of the peaks X and A respectively, measured on the X-ray diffractogram and corrected for the base line.

18. An aramid monofilament according to claim 17, in which the parameter alpha satisfies the following relationship:

$alpha \geqq 0.70 - \exp(-D/80)$.

19. An aramid monofilament according to claim 1, in which a different crystalline structure between the core and the skin.

20. An aramid monofilament according to claim 1, in which it is in as-spun state.

21. A method of obtaining at least one aramid monofilament having the following relationships:

$1.7 \leqq Ti \leqq 260$;

$40 \leqq D \leqq 480$;

$T \geqq 170 - D/3$;

$Mi \geqq 2000$;

Ti being the linear density in tex, D being the diameter in μm (micrometers), T being the tenacity in cN/tex, and Mi being the initial modulus in cN/tex for this monofilament, said method comprising the following steps:

(a) forming a solution of at least one aromatic polyamide such that at least 85% of the amide linkages (—CO—NH—) are joined directly to two aromatic rings, the inherent viscosity V.I.(p) of this polyamide or these polyamides being at least equal to 4.5 dl/g, the concentration C of polyamide(s) in the solution being at least 20% by weight, said spinning composition being optically anisotropic in the molten state and at rest;

(b) extruding this solution in a spinneret through at least one capillary the diameter "d" of which is greater than 80 μm, the spinning temperature Tf, that is to say the temperature of the solution upon its passage through the capillary, being at most equal to 105° C.;

(c) drawing the liquid jet emerging from the capillary in a non-coagulating layer of fluid;

(d) introducing the drawn liquid vein thus obtained into a coagulating medium, the monofilament thus in course of formation remaining in dynamic contact with the coagulating medium for the time "t", the temperature of the coagulating medium Tc being at most equal to 16° C.;

(e) and washing and drying the monofilament; the diameter D of the dry monofilament which has thus been completed and the time t having the following relationships:

$T = KD^2; K)$ 30 t being expressed in seconds and D being expressed in millimeters.

22. A method according to claim 21, in which at least one of the following relationships is satisfied:

$V.I(p) \geqq 5.3$ dl/g;

$C \geqq 20.2\%$;

$Tf \leqq 90°$ C.;

$Tc \leqq 10°$ C.;

$K \geqq 200$ sec/mm².

23. A method according to either of claims 21 and 22, in which at least one of the following relationships is satisfied:

$1/d < 10$;

5 degrees $\leqq \beta \leqq 90$ degrees;

3 mm≦e≦20 mm;

2≦FEF≦15,

"l" being the length of the capillary in μm, β being the opening angle of a convergent preceding the capillary, "e" being the thickness of the non-coagulating layer, and FEF being the spin sketch factor.

24. A method according to claim 21, in which the coagulating medium is an aqueous solution of sulfuric acid.

25. A method according to claim 21, in which the monofilament in course of formation is subjected to tensions of less than 3 cN/tex.

26. A method according to claim 21, in which the drying temperature is at most equal to 200° C.

27. A method according to claim 21, in which the inherent viscosities V.I(f) and V.I(p), expressed in dl/g, are related by the relationship V.I(f)≧V.I(p)−0.8, V.I(f) being the inherent viscosity of the monofilament.

28. A method according to claim 21, in which the solution is prepared with sulfuric acid, the concentration of which by weight of acid is close to 100%.

29. A method according to claim 21, in which it is carried out starting from at least one aromatic polyamide having essentially p-phenylene terephthalamide units.

30. A method according to claim 21, in which it is carried out starting with poly(p-phenylene terephthalamide).

31. An assembly of monofilaments comprising at least one aramid monofilament according to claim 1.

32. An article reinforced by at least one aramid monofilament according to claim 1.

33. An article reinforced by at least one assembly according to claim 31.

34. An article according to either of claims 32 and 33, characterized by the fact that it is a tire.

* * * * *

UNITED STATES PATENT AND TRADEMARK OFFICE

CERTIFICATE OF CORRECTION

PATENT NO. : 5,246,776

DATED : September 21, 1993

INVENTOR(S) : Meraldi et al.

It is certified that error appears in the above-indentified patent and that said Letters Patent is hereby corrected as shown below:

Col. 1, line 19, "EP-A-3,671,542" should read --U.S. Pat. No. 3,671,542--

Col. 1, line 61, "Coagulation should read --coagulation--

Col. 1, line 67, "374,978" should read --4,374,978--

Col. 2, line 5, "a 100" should read --of 100--

Col. 2, line 45, "polyethy" should read --polyethylene for example--

Col. 2, line 57, "as spun" should read --as-spun--

Col. 3, bridging lines 19 and 20, delete "non-coagulating non-coagulating"

Col. 5, line 47, "analysis" should read --analysis: --

Col. 5, line 53, "Aloha" should read --Alpha--

Col. 6, line 18, "pictures" should read --photographs--

Col. 6, line 46, "The" should read --The crushed--

Col. 11, line 5, "l/d" should read --l/d: --

UNITED STATES PATENT AND TRADEMARK OFFICE

CERTIFICATE OF CORRECTION

PATENT NO. : 5,246,776

DATED : September 21, 1993

INVENTOR(S) : Meraldi et al.

It is certified that error appears in the above-indentified patent and that said Letters Patent is hereby corrected as shown below:

Col. 12, line 3, "sec $mm^2$" should read --sec/$mm^2$--

Col. 12, TABLE 1, test No. K-3, under heading "FEF", "7.1" should read --7.7--

Col. 12, TABLE 1, test No. L-1, under heading "$V_2$", "200" should read --220--

Col. 13, TABLE 2, test No. B-2, under heading "Mi", "6352" should read --6362--

Col. 13, TABLE 2, test No. D-5, under heading "Ar", "2.69" should read --3.69--

Col. 16, line 36, "apparent" should read --apparent maximum--

Col. 16, line 43, "corresponds" should read --corresponding--

Col. 17, line 18, "1 420 g/$cm^3$" should read --1.420 g/$cm^3$--

Col. 19, TABLE 4, test No. Q-3, under heading "ρ", "2.422" should read --1.422--

Col. 19, line 58, "alpha 0.70" should read --alpha ≥ 0.70--

Col. 19, line 65, "g cm" should read --g/$cm^3$

Col. 20, line 22, "elementum" should read --elementary--

Col. 20, line 26, "Multifilaments" should read --MULTIFILAMENTS--

UNITED STATES PATENT AND TRADEMARK OFFICE

CERTIFICATE OF CORRECTION

PATENT NO. : 5,246,776

DATED : September 21, 1993

INVENTOR(S) : Meraldi et al.

It is certified that error appears in the above-indentified patent and that said Letters Patent is hereby corrected as shown below:

Col. 20, line 62 "mono-filaments" should read --monofilaments--

Col. 21, line 22, "(90°C.," should read --(90°C.),--

Col. 21, line 23, "(spin draft facter)" should read --(spin stretch factor)--

Col. 22, line 47, "Ep-A-331 156" should read --EP-A-331 156--

Col. 26, line 5, "(curve $C_{8-2}$)" should read --(curve $C_{8-2}$): --

Col. 27, TABLE 12, test No. U-8, under heading "T(cN/tex)", "205" should read --206--

Col. 27, line 50, "(curve $C_{9-2}$)" should read --(curve $C_{9-2}$): --

Col. 27, line 63, "EP-A-168 879U.S." should read --EP-A-168 879, U.S.--

Col. 30, TABLE 15, test No. W-2, under heading "e", "112" should read --12--

Col. 32, TABLE 17, test No. A.A-1, under heading "Tc", "$\geqq$7" should read --$\leq$7--

Col. 36, lines 2-3, "peaks X and A" should read --peaks (X) and (A)--

UNITED STATES PATENT AND TRADEMARK OFFICE

CERTIFICATE OF CORRECTION

PATENT NO. : 5,246,776

DATED : September 21, 1993

INVENTOR(S) : Meraldi et al.

It is certified that error appears in the above-indentified patent and that said Letters Patent is hereby corrected as shown below:

Col. 36, lines 9-10, "in which a different" should read --having a different--

Col. 36, line 53, "$T=KD^2;K)30$" should read --$T=KD^2;K>30$--

Col. 37, line 6, "spin sketch factor" should read --spin stretch factor--

Signed and Sealed this

Twenty-seventh Day of December, 1994

Bruce Lehman

*Attest:*

BRUCE LEHMAN

*Attesting Officer*

*Commissioner of Patents and Trademarks*